US009162452B2

(12) United States Patent
Kitaoka

(10) Patent No.: US 9,162,452 B2
(45) Date of Patent: Oct. 20, 2015

(54) IMAGE FORMING APPARATUS

(71) Applicant: Satoshi Kitaoka, Kanagawa (JP)

(72) Inventor: Satoshi Kitaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 293 days.

(21) Appl. No.: 13/726,792

(22) Filed: Dec. 26, 2012

(65) Prior Publication Data

US 2013/0162707 A1 Jun. 27, 2013

(30) Foreign Application Priority Data

Dec. 27, 2011 (JP) ..... 2011-286413

(51) Int. Cl.

*B41J 25/308* (2006.01)
*B41J 2/135* (2006.01)
*B41J 2/165* (2006.01)

(52) U.S. Cl.

CPC ..... *B41J 2/135* (2013.01); *B41J 2/16547* (2013.01); *B41J 2/16585* (2013.01); *B41J 25/3088* (2013.01); *B41J 2002/16591* (2013.01)

(58) Field of Classification Search

USPC ..... 347/37, 40
See application file for complete search history.

(56) References Cited

U.S. PATENT DOCUMENTS

| | | | | |
|---|---|---|---|---|
| 5,157,415 | A * | 10/1992 | Seyasu | 347/197 |
| 6,419,334 | B1 * | 7/2002 | Akuzawa et al. | 347/8 |
| 2007/0046721 | A1 * | 3/2007 | Miyazawa | 347/29 |
| 2007/0285462 | A1 | 12/2007 | Iwakura | |
| 2008/0079771 | A1 * | 4/2008 | Sakaida | 347/33 |
| 2010/0231643 | A1 | 9/2010 | Saiga et al. | |
| 2011/0141192 | A1 | 6/2011 | Komuro et al. | |
| 2011/0220017 | A1 | 9/2011 | Kitaoka et al. | |
| 2011/0310185 | A1 | 12/2011 | Komaba et al. | |
| 2012/0060754 | A1 | 3/2012 | Kitaoka et al. | |
| 2012/0160161 | A1 | 6/2012 | Sakura et al. | |
| 2012/0249627 | A1 | 10/2012 | Komaba et al. | |
| 2012/0262519 | A1 | 10/2012 | Hoshino et al. | |

FOREIGN PATENT DOCUMENTS

| | | |
|---|---|---|
| JP | 2006-212995 | 8/2006 |
| JP | 2007-105909 | 4/2007 |
| JP | 2010-30270 | 2/2010 |
| JP | 2010-208250 | 9/2010 |
| JP | 2010-274486 | 12/2010 |
| JP | 2011-011498 | 1/2011 |
| JP | 4667300 | 4/2011 |
| JP | 2011-121319 | 6/2011 |
| JP | 2011-136507 | 7/2011 |

* cited by examiner

*Primary Examiner* — Matthew Luu
*Assistant Examiner* — Lily Kemathe
(74) *Attorney, Agent, or Firm* — Cooper & Dunham LLP

(57) ABSTRACT

An image forming apparatus includes a liquid jetting head for jetting liquid onto a recording medium and a movement mechanism for moving the liquid jetting head orthogonal to the recording medium. The movement mechanism includes translation cams movable in a direction orthogonal to the movement of the liquid jetting head, each of the translation cams including a cam gap into which a protruding part of the liquid jetting head is inserted. Each cam gap includes a parallel part and a slope part. The cap gaps of the translation cams are configured so as to constantly maintain a relationship in which when the protruding part is positioned in the slope part of the cap gap of one of the translation cams, the protruding part is positioned in the parallel part of the cap gap of the other translation cam.

6 Claims, 40 Drawing Sheets

IMAGE FORMING APPARATUS

BACKGROUND OF THE INVENTION

1. Field of the Invention

The present invention relates to image forming apparatuses.

2. Description of the Related Art

There is known an inkjet type image forming apparatus provided with a liquid droplet jetting head for jetting ink droplets. The inkjet type image forming apparatus forms images by applying ink droplets onto a recording medium while conveying the recording medium.

An "image forming apparatus" means a device for forming images by jetting liquid onto an image recording medium such as paper, threads, fiber, cloth, leather, metal, plastic, glass, wood, and ceramics. "Image forming" does not only mean applying images with meaning such as characters and figures onto an image recording medium, but also means applying images without meaning such as patterns onto an image recording medium (merely jetting liquid onto an image recording medium). Furthermore, "ink" is not limited to so-called ink. Ink is not particularly limited as long as it is a liquid when jet. Ink is used as a collective term of liquids such as a DNA sample, resist, and a pattern material. Furthermore, an "image" is not limited to being applied onto a plane; the image may also be applied onto a three-dimensional object, or the image itself may form a three-dimensional object.

The inkjet type image forming apparatus includes a serial type and a line type. With a serial type image forming apparatus, an image is formed on a sheet while moving the liquid droplet jetting head in a sheet width direction. With a line type image forming apparatus, the liquid droplet jetting head is wider than the width of a sheet that can be conveyed by the device, and an image is formed on the sheet while fixing the liquid droplet jetting head.

An inkjet type image forming apparatus described above includes a maintenance recovery device having a function of maintaining and recovering the performance of the liquid droplet jetting head. The maintenance recovery device has a cap function for capping nozzle surfaces with a cap member having high sealing properties for preventing the ink around the nozzles from thickening and solidifying due to natural, evaporation of the ink. Furthermore, the maintenance recovery device has a suction discharge function for suctioning and discharging ink with the nozzles of the liquid droplet jetting head for recovering from the state where jetting failures occur due to air bubbles generated in the nozzles, to a proper state. Furthermore, the maintenance recovery device has a wiping function for wiping, with a wiper blade, ink that has adhered to the nozzle surfaces, which may cause variations in the flying properties of the ink droplets that are jet from the nozzles.

As described in patent document 1, in a line type device, the maintenance recovery device is provided adjacent to the liquid droplet jetting head. When maintenance/recovery is performed on the liquid droplet jetting head by the maintenance recovery device, first, the liquid droplet jetting head is raised. Next, the maintenance recovery device is moved underneath the liquid droplet jetting head. Then, a predetermined maintenance recovery operation is executed by the maintenance recovery device. When forming an image, the maintenance recovery mechanism is withdrawn, and then the liquid droplet jetting head is lowered to a position where the gap between the liquid droplet jetting head and the sheet is an appropriate size.

In the line type device, it is necessary to precisely stop the liquid droplet jetting head at various positions, such as the position for forming an image onto plain paper, the position for forming an image onto cardboard, a withdraw position for allowing the maintenance recovery device to move underneath the liquid droplet jetting head, the cap position where the nozzle surfaces are caused to contact the caps of the maintenance recovery device, and a wiping position where the wiper blade of the maintenance recovery device is caused to contact the nozzle surfaces.

FIG. 35 illustrates a conventional head elevating mechanism 410 for raising and lowering the liquid droplet jetting head.

As shown in FIG. 35, the head elevating mechanism 410 includes plural feed screws 400 inserted in screw holes provided in a head part 40 and plural detection sensors 401 for detecting the head part 40. By rotating the plural feed screws 400 in synchronization, the head part 40 is raised/lowered. Based on a detection result of detecting the head part 40 obtained by the detection sensors 401, the rotation of the plural feed screws 400 is stopped, and the head part 40 is stopped at a predetermined height.

In the head elevating mechanism 410 shown in FIG. 35, when the rotation of the feed screws 400 is stopped based on the detection result of the detection sensors 401, the feed screws 400 move by the inertia of a driving motor. Therefore, the head part 40 cannot be precisely stopped at the respective positions.

Furthermore, it is necessary to implement control based on the detection result for precisely stopping the driving motor that rotates the feed screws 400. This leads to an increase in the cost of the device.

Patent Document 1: Japanese Laid-Open Patent Publication No. 2011-11498

SUMMARY OF THE INVENTION

The present invention provides an image forming apparatus, in which one or more of the above-described disadvantages are eliminated.

A preferred embodiment of the present invention provides an image forming apparatus by which costs of the device are prevented from increasing and the liquid droplet jetting head can be precisely stopped.

According to an aspect of the present invention, there is provided an image forming apparatus including a liquid droplet jetting head configured to jet liquid droplets onto a recording medium; and a movement mechanism configured to move the liquid droplet jetting head in a direction orthogonal to a liquid droplet jet receiving surface of the recording medium, wherein the movement mechanism includes a plurality of translation cams provided in a manner to be movable in a direction orthogonal to a movement direction of the liquid droplet jetting head, each of the plurality of translation cams including a cam gap into which a protruding part provided on the liquid droplet jetting head is inserted, the cam gap of each of the plurality of translation cams includes a parallel part extending in a parallel direction with respect to the movement direction of the liquid droplet jetting head and a slope part that is sloped with respect to the movement direction of the liquid droplet jetting head, and the cap gaps of the plurality of translation cams are configured so as to constantly maintain a relationship in which when the protruding part is positioned in the slope part of the cap gap of any one of the plurality of translation cams, the protruding part is positioned in the parallel part of the cap gap of a remaining one of the plurality of translation cams.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given of an inkjet printer as an inkjet type image forming apparatus according to an embodiment of the present invention.

Figure 1:
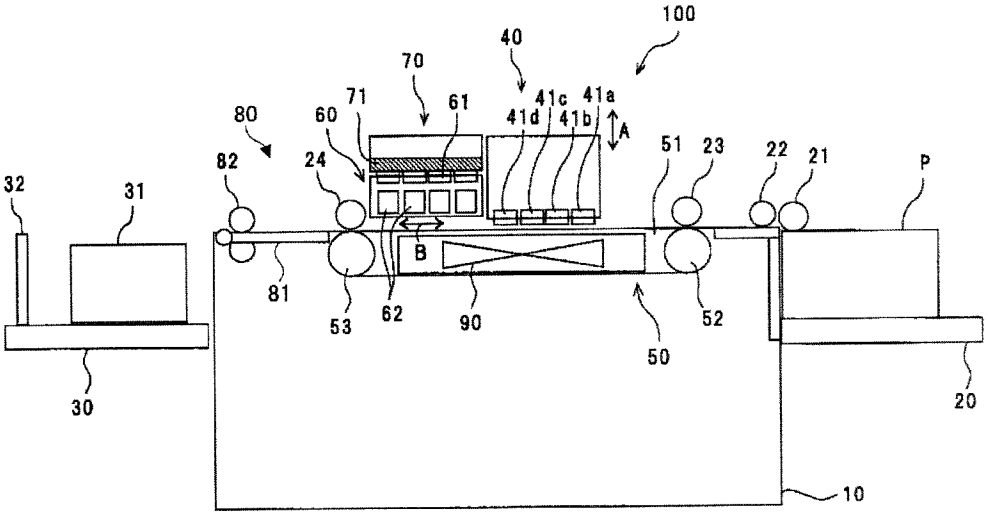
FIG. 1 is a schematic front view of an inkjet printer according to an embodiment.
Figure 2:
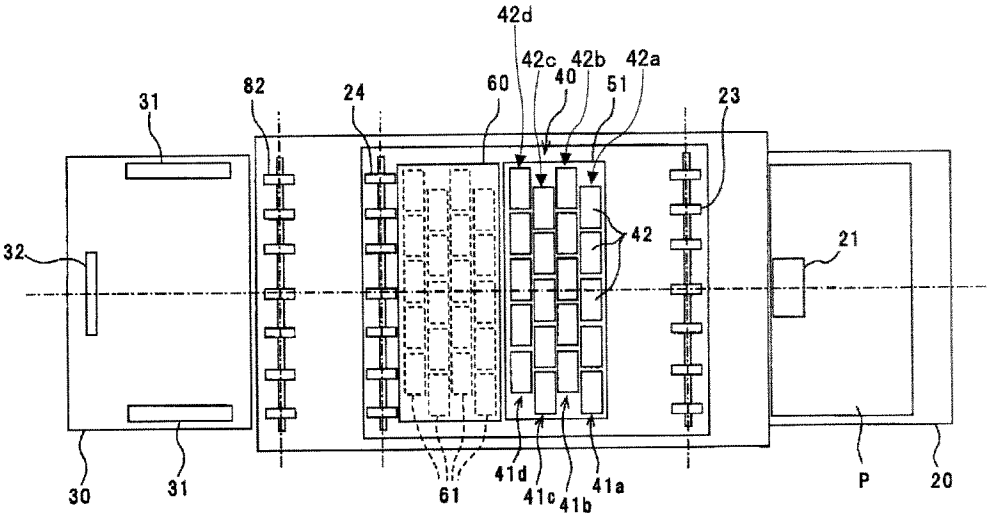
FIG. 2 is a schematic top view of the inkjet printer.

FIG. 1 is a schematic front view of an inkjet printer 100, and FIG. 2 is a schematic top view of the inkjet printer 100.

The inkjet printer 100 includes a device main unit 10 including a sheet feeding tray 20 for stacking and feeding sheets P, a sheet eject tray 30 for stacking ejected sheets P on which printing has been performed, and a conveying unit 50 for conveying a recording medium from the sheet feeding tray 20 to the sheet eject tray 30. Above a device main unit 10, a head part 40 and a head maintenance device 60 are provided.

The head part 40 includes four line heads 41*a*, 41*b*, 41*c*, 41*d* arranged in a zigzag manner in the movement direction of the recording medium (sub scanning direction). Each of the line heads includes five recording heads 42 aligned along the width direction of the recording medium (main scanning direction). Each of the recording heads 42*a* of the first line head 41*a* includes a nozzle row for jetting yellow (Y) ink and a nozzle row for jetting magenta (M) ink. Similarly, each of the recording heads 42*b* of the second line head 41*b* includes a nozzle row for jetting yellow (Y) ink and a nozzle row for jetting magenta (M) ink. Each of the recording heads 42*c* of the third line head 41*c* includes a nozzle row for jetting cyan (C) ink and a nozzle row for jetting black (K) ink. Each of the recording heads 42*d* of the fourth line head 41*d* includes a nozzle row for jetting cyan (C) ink and a nozzle row for jetting black (K) ink.

In the present embodiment, by arranging the line heads in a zigzag manner, it is possible to form an image having a pixel density that is two times that of the pixel density that each line head can form in the main scanning direction. Specifically, in the present embodiment, an image of 150 dpi in the main scanning direction is formed.

The configuration of the head part 40 is not limited to the above. For example, the head part 40 may have a configuration in which eight line heads are arranged in a zigzag manner in the sub scanning direction, the first and second line heads jet Y colored ink, the third and fourth line heads jet M colored ink, the fifth and sixth line heads jet C colored ink, and the seventh and eighth line heads jet K colored ink. In the present embodiment, plural recording heads are arranged in the main scanning direction to constitute a line head; however, a single recording head may constitute a line head. Furthermore, the arrangement of the respective colors is not particularly limited.

Above the head part 40, branch pipes (not shown) corresponding to the respective recording heads 42 are provided for supplying ink to the corresponding recording heads 42. Sub tanks (not shown) are arranged on the upstream side in the ink movement direction with respect to the branch pipes. According to the water head difference between the sub tanks and the recording heads 42, the meniscuses of the nozzles of the recording heads 42 can be maintained at an appropriate negative pressure for holding the ink. Furthermore, main tanks (not shown) for storing ink are arranged on the upstream side in the ink movement direction with respect to the sub tanks.

Furthermore, the head part 40 is movable in the perpendicular direction with respect to the sheet conveying direction. The head part 40 rises to a position for securing a space for the head maintenance device 60 to be situated underneath the head part 40, at the time of performing maintenance described below.

Above the device main unit 10 and on the left side of the head part 40 as viewed in FIG. 1, there is provided the head maintenance device 60 and a cleaning unit 70. The head maintenance device 60 includes a number of maintenance recovery mechanisms 61 corresponding to the number of recording heads 42. The maintenance recovery mechanisms 61 include caps 61*a* (see FIG. 5) for capping each of the nozzle surfaces of the recording heads 42, and wiper blades 61*b* (see FIG. 5) for cleaning the nozzle surfaces. The plural maintenance recovery mechanisms 61 are arranged similarly to the arrangement of the recording heads 42 of the head part 40. That is, four rows of maintenance recovery mechanisms 61 are arranged in a zigzag manner in the sub scanning direction, with each row including five maintenance recovery mechanisms 61 arranged in the main scanning direction. Below the maintenance recovery mechanisms 61, there are four pressure chambers 62 corresponding to the rows of maintenance recovery mechanisms 61. The pressure chambers 62 are connected to the caps 61*a* of the corresponding maintenance recovery mechanisms 61 by flow path pipes. To the pressure chambers 62, suction units (not shown) are connected. In the present embodiment, the pressure chambers and the suction units are provided under the maintenance recovery mechanisms 61; however, the present invention is not so limited. To make the device compact, the pressure chambers and the suction units may be provided outside the back plate of the device main unit 10, and the flow path pipes may be constituted by tubes for connecting the pressure chambers and the caps. This head maintenance device 60 can move by sliding along the sheet conveying direction. At the time of forming images, the head maintenance device 60 is positioned on the left side of the head part 40 as viewed in FIG. 1, which is underneath the cleaning unit 70. When the head maintenance device 60 performs maintenance, the head part 40 moves upward. Then, the head maintenance device 60 moves by sliding to be situated underneath the recording heads 42.

The cleaning unit 70 includes a porous body 71 on the bottom surface. The cleaning unit 70 performs cleaning by wiping off the ink adhering to the wiper blades 61*b* and the rims of the caps 61*a* with the porous body 71. The cleaning unit 70 includes an accommodating part for accommodating the porous body 71 in a rolled state by winding the porous body 71 around a shaft member, and a recovering part for recovering the porous body 71 that has been soiled with ink by winding the porous body 71 around a shaft member in a rolled state. When the porous body 71 facing the head maintenance device 60 is soiled, the shaft member of the recovering part is rotated so that the soiled porous body 71 is wound around the shaft member of the recovering part. At the same time, a porous body 71 that is not soiled with ink is sent out to a position facing the head maintenance device 60 from the accommodating part.

In a non-standby state such as when the power is turned off, the head maintenance device 60 is situated underneath the recording heads 42, and the caps 61*a* of the maintenance recovery mechanisms 61 are capping the nozzle surfaces of the recording heads 42, to maintain the nozzles in a moist state. Furthermore, when the number of sheets of forming images reaches a predetermined value, or when the user executes a cleaning mode with an operation unit (not shown), the following operation is performed. A suction unit (not shown) is used to suction the air bubbles and dust adhering to the nozzles together with ink while the recording heads 42 are capped by the caps 61*a*, to improve jetting failures.

The device main unit 10 is constituted by front and back plates (not shown) and a stay. Inside the device main unit 10, the conveying unit 50 and a suction fan 90 are provided.

The conveying unit 50 includes an endless conveying belt 51. The conveying belt 51 is wound around a driving roller 53 and a subordinate roller 52 by an appropriate tension. The conveying belt 51 includes plural suction pores. The driving roller 53 is rotated at a predetermined speed by a driving motor (not shown), and as the driving roller 53 is rotated, the conveying belt 51 is also rotated at a predetermined speed. The conveying unit 50 includes an inlet guide roller 23 for pressing the sheet P against the conveying belt 51 at a position facing the subordinate roller 52. Furthermore, the conveying unit 50 includes an outlet guide roller 24 for pressing the sheet P against the conveying belt 51 at a position facing the driving roller 53. A plurality of inlet guide rollers 23 and outlet guide rollers 24 are provided in the width direction of the sheet P as shown in FIG. 2, and are supported by gravity by a guide member (not shown) for guiding the sheet P.

At the bottom part of the conveying unit 50 as viewed in FIG. 1, there is provided the suction fan 90. By the suction fan 90, the sheet P that has moved onto the conveying belt 51 from the sheet feeding tray 20 is suctioned onto the front surface of the conveying belt 51. In the present embodiment, plural suction holes are provided in the conveying belt 51 so that the sheet P is suctioned onto the conveying belt 51 by the suction fan 90. However, in another example, a charging means for charging the conveying belt may be provided, and the sheet P may be conveyed while being suctioned onto the conveying belt by static electricity.

In the downstream side of the conveying unit 50 in the sheet conveying direction, a sheet eject guide unit 80 is provided. The sheet eject guide unit 80 includes a sheet eject guide plate 81 and a sheet eject roller pair 82 for guiding the sheet P, which are facing the side of the sheet P opposite to the image forming side of the sheet P. The sheet eject roller pair 82 is supported by the sheet eject guide plate 81. The sheet P that has been conveyed by the sheet eject roller pair 82 is ejected onto the sheet eject tray 30. The sheet eject tray 30 includes a pair of side fences 31 for restricting the sheet P in the width direction, and an end fence 32 for restricting the leading edge of the sheet P.

Next, a description is given of an image forming operation of the inkjet printer 100 according to the present embodiment. When image data that is image information is received via a communication cable from an external device such as a personal computer (not shown), the sheet P on the sheet feeding tray 20 is conveyed to the ink jetting area. Specifically, rotation of a sheet feeding roller 21 starts, and the top sheets P on the sheets P stacked on the sheet feeding tray 20 are sent out toward a separation roller 22. One sheet P is separated, by the separation roller 22, from the sheets P that have been sent out from the sheet feeding tray 20 by the sheet feeding roller 21, and the separated sheet P is conveyed to the conveying unit 50. The sheet P that has been conveyed to the conveying unit 50 is pressed against the conveying belt 51 by the inlet guide roller 23. The sheet P on the conveying belt 51 is suctioned onto the front side of the conveying belt 51 by the suction fan 90, and is conveyed according to the endless movement of the conveying belt 51.

When the sheet P has reached the ink jetting area, a control unit (not shown) controls the recording heads 42 based on the image data, and ink droplets are jet from predetermined nozzles to form an image on the sheet P. The sheet P on which an image is formed is conveyed to the sheet eject guide unit 80 by the conveying belt 51, and is ejected, by the sheet eject roller pair 82 of the sheet eject guide unit 80, to an area surrounded by the end fence 32 and the side fences 31 of the sheet eject tray 30.

Next, a description is given of a maintenance operation performed by the head maintenance device 60. In the present embodiment, the maintenance operation is performed before printing characters and before capping.

FIGS. 3A through 3E illustrate a maintenance operation performed before printing characters.

Figure 3A:
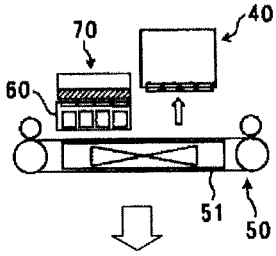
FIGS. 3A through 3E illustrate a maintenance operation performed before forming images.
Figure 3B:
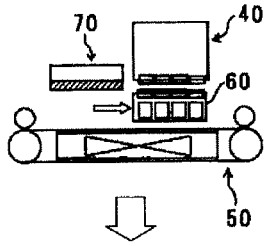
Figure 3C:
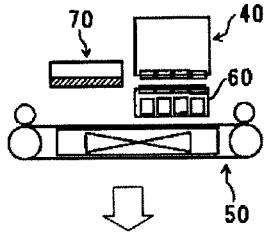
Figure 3D:
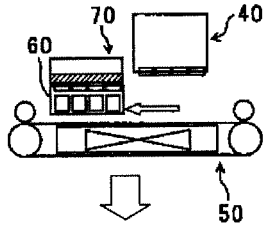
Figure 3E:
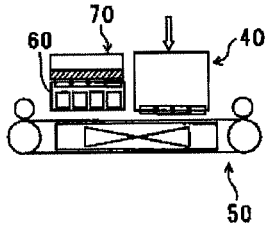

In the maintenance operation before printing characters, when image data that is image information is received via a communication cable from an external device such as a personal computer (not shown), as shown in FIG. 3A, the head part 40 is raised, and then as shown in FIG. 3B, the head maintenance device 60 is moved to the sheet feeding side and moved underneath the head part 40. Then, as shown in FIG. 3C, a predetermined maintenance operation described below is executed. After the maintenance operation ends, as shown in FIG. 3D, the head maintenance device 60 is slid to the sheet eject side, and moved underneath the cleaning unit 70. When the movement of the head maintenance device 60 ends, the head part 40 is lowered, and printing of characters (image forming operation) is started.

FIGS. 4A through 4D illustrate a maintenance operation performed before capping.

Figure 4A:
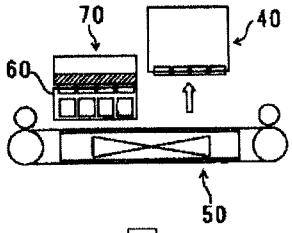
FIGS. 4A through 4D illustrate a maintenance operation performed before capping.
Figure 4B:
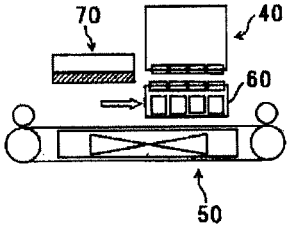
Figure 4C:
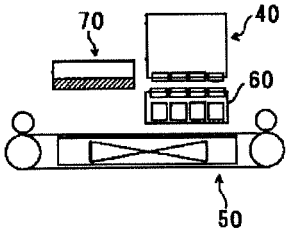
Figure 4D:
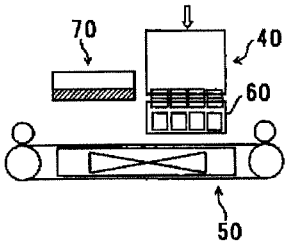

In the maintenance operation performed before capping, for example, when the power switch is turned off and the inkjet printer 100 is switched from a standby state to a non-standby state, as shown in FIG. 4A, the head part 40 is raised, and then as shown in FIG. 4B, the head maintenance device 60 is moved to the sheet feeding side and moved underneath the head part 40. Then, as shown in FIG. 4C, a predetermined maintenance operation described below is executed. After the maintenance operation ends, as shown in FIG. 4D, the head part 40 is lowered, and caps (not shown) are used to cap the nozzle surfaces of the recording heads 42 of the head part 40.

Figure 5:
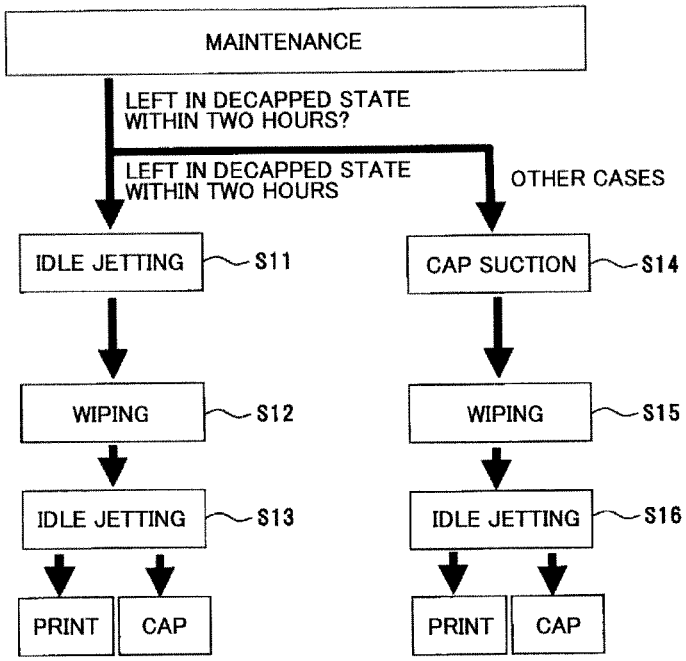
FIG. 5 is a control flow chart of the maintenance operation.

FIG. 5 is a control flow chart of the maintenance operation.

When the power switch is turned on and the inkjet printer 100 switches from a non-standby state to a standby state, the caps of the recording heads 42 are removed, and the head maintenance device 60 moves underneath the cleaning unit 70. Next, the head part 40 is lowered to a state as shown in FIG. 1. When the inkjet printer 100 is switched to the standby state, the control unit (not shown) starts measuring the time, and when the printing operation ends, the control unit resets the time.

When the maintenance operation is executed, the control unit (not shown) reads the measured time, and checks whether the measured time is within two hours. When the measured time is within two hours, idle jetting is performed (step S11), and the wiper blades 61*b* are used to wipe the nozzle surfaces (step S12). Then, idle jetting is performed in the caps 61*a* (step S13), and the meniscuses of the nozzles are adjusted.

Meanwhile, when the measured time exceeds two hours, cap suction is performed (step S14). Specifically, in a state where the recording heads 42 are capped by the caps 61*a*, a suction unit (not shown) is used to suction air bubbles and dust adhering to the nozzles, together with the ink. After performing cap suction, the wiper blades 61*b* are used to wipe the nozzle surfaces (step S15). Subsequently, idle jetting is performed in the caps 61*a* (step S16), and the meniscuses of the nozzles are adjusted. Furthermore, after the cap suction, pressurizing maintenance may be performed. Pressurizing maintenance is performed by supplying ink from the tank and applying pressure inside the nozzles, to remove air bubbles that have been generated in the nozzles. At the time of pressurizing maintenance, similar to the time of idle jetting, the caps 61*a* are facing and spaced apart from the recording heads 42. When ink is supplied from the tank and pressure is applied to the inside of the nozzles, ink droplets drop from the nozzles, and therefore the ink that has dropped from the nozzles is received by the caps 61*a*.

Figure 6:
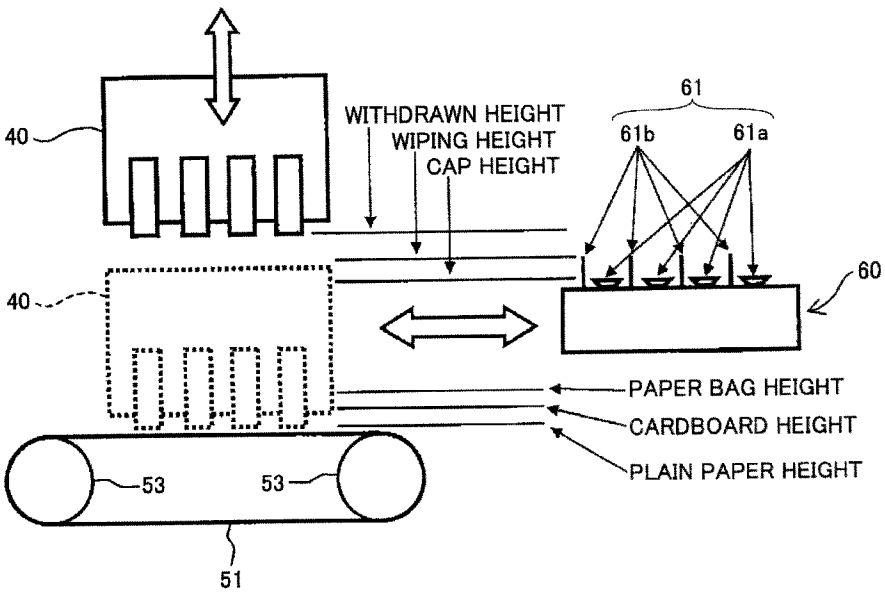
FIG. 6 is a front view illustrating heights to which head part 40 can be raised/lowered for printing to respective types of recording medium.

As shown in FIG. 6, the head part 40 according to the present embodiment is raised/lowered so as to be positioned at a height for printing images onto plain paper, a height for printing images onto cardboard, and a height for printing images onto a paper bag such as a medicine bag. Furthermore, the head part 40 is raised/lowered so as to be positioned at a height where the head maintenance device 60 can be withdrawn and moved underneath the head part 40, a height where the wiper blades 61*b* are used for wiping the nozzle surfaces, and a height where the nozzle surfaces of the recording heads 42 are brought in contact with the caps 61*a* at the time of cap suction.

Next, a description is given of an elevating mechanism for raising/lowering the head part 40, which is the feature of the present embodiment.

Figure 7:
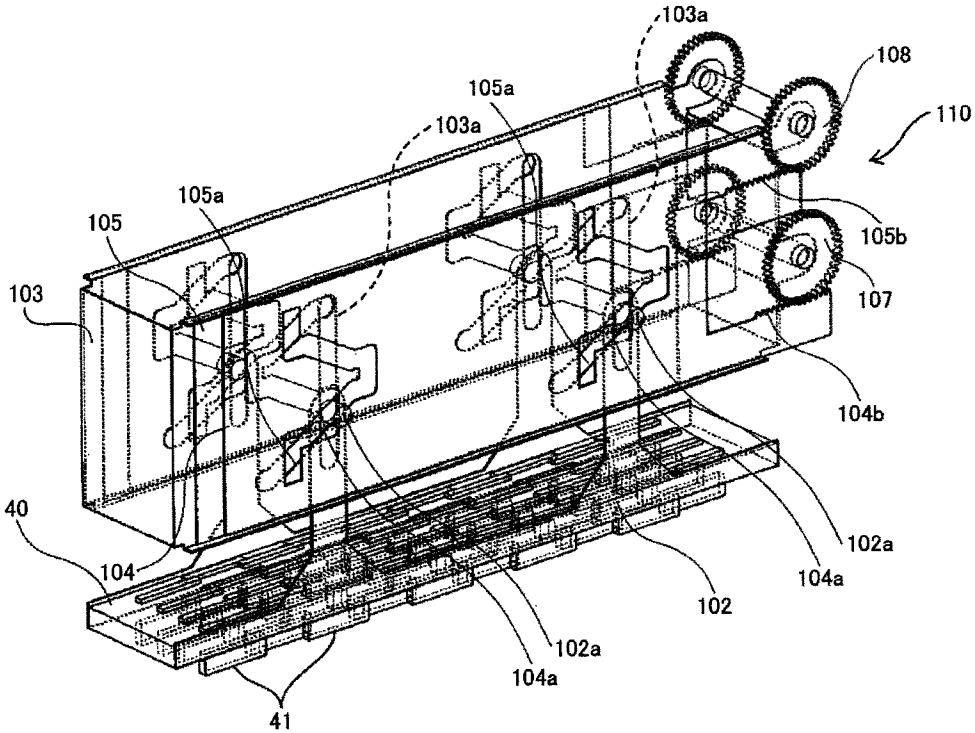
FIG. 7 is a perspective view of an elevating mechanism.
Figure 8:
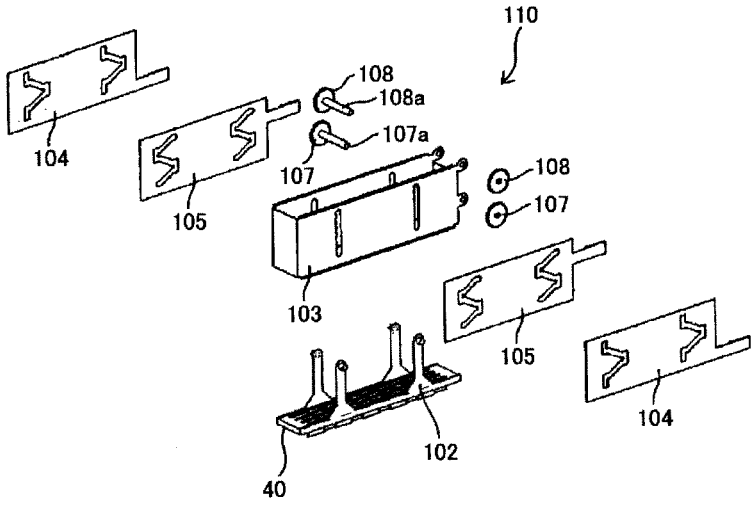
FIG. 8 is an exploded perspective view of the elevating mechanism.

FIG. 7 is a perspective view of an elevating mechanism 110 and FIG. 8 is an exploded perspective view of the elevating mechanism 110.

As shown in FIG. 7, the elevating mechanism 110 is a moving mechanism for moving the head part 40 that is a liquid droplet jetting head in a direction orthogonal to the liquid droplet jet receiving surface of the sheet P that is a recording medium. This elevating mechanism 110 includes a pair of head brackets 102 for holding the head part 40, a frame 103 for holding the pair of head brackets 102 in a manner that the head brackets 102 can be raised/lowered, a pair of first translation cams 105, and a pair of second translation cams 104.

Figure 9:
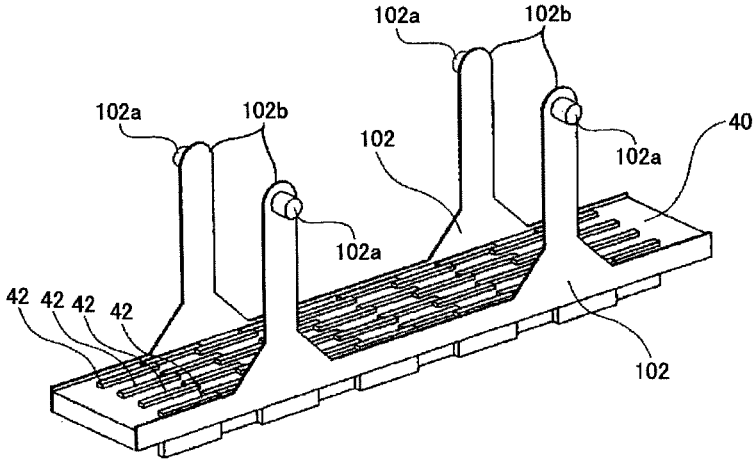
FIG. 9 is a perspective view of a head part and a pair of head brackets.

FIG. 9 is a perspective view of the head part 40 and the pair of head brackets 102.

As shown in FIG. 9, the head brackets 102 are attached to the front edge surface and the back edge surface of the head part 40 as viewed in FIG. 9. Arm parts 1026 extending vertically are provided on one end and another end of the head bracket 102 in the longitudinal direction. At the edge of each arm part 102*b*, there is provided a move-use pin 102*a*.

Figure 10:
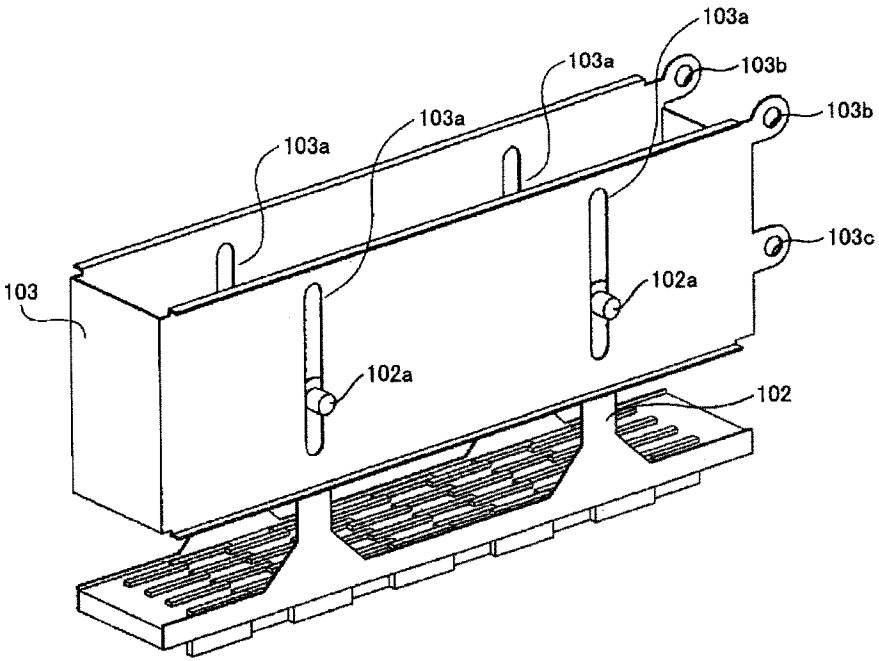
FIG. 10 is a perspective view of a configuration including a frame added to the configuration of FIG. 9.

FIG. 10 is a perspective view of a configuration including the frame 103 added to the configuration of FIG. 9.

As shown in FIG. 10, the frame 103 is a rectangular tube. On the front side wall and the back side wall of the frame 103 as viewed in FIG. 10, there are guide holes 103*a* that extend vertically. In the guide holes 103*a*, the move-use pins 102*a* of the pair of head brackets 102 are inserted so as to be movable in the vertical direction. By inserting the move-use pins 102*a* in the guide holes 103*a*, the head part 40 cannot freely move in directions other than the vertical direction. Furthermore, on the right edge of the frame 103 as viewed in FIG. 10, there are first supporting holes 103*b* for rotatably supporting a first rotating shaft 108*a* (see FIG. 12) to which first pinion gears 108 (see FIG. 12) are fixed, and second supporting holes 103*c* for rotatably supporting a second rotating shaft 107*a* (see FIG. 8) to which second pinion gears 107 (see FIG. 14) are fixed.

Figure 11:
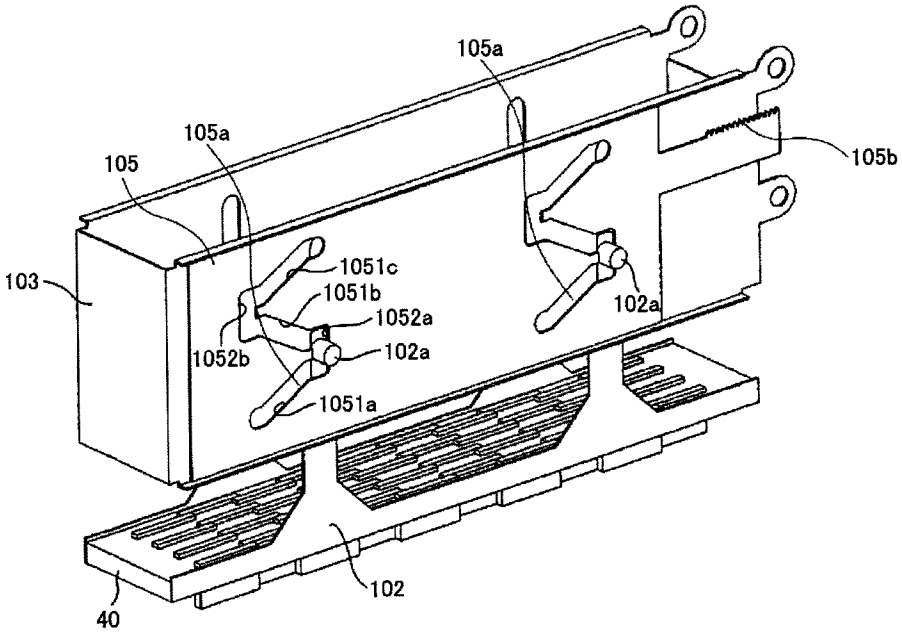
FIG. 11 is a perspective view of a configuration including a pair of first translation cams added to the configuration of FIG. 10.

FIG. 11 is a perspective view of a configuration including the pair of first translation cams 105 added to the configuration of FIG. 10.

As shown in FIG. 11, the first translation cams 105 are shaped as a plate, and are respectively provided so as to face the front side plate and the back side plate of the frame 103.

At one end and another end of each of the first translation cams 105 in the longitudinal direction, the move-use pins 102*a* are inserted, and first cam gaps 105*a* are formed as holes in which the move-use pins 102*a* can relatively move.

Figure 12:
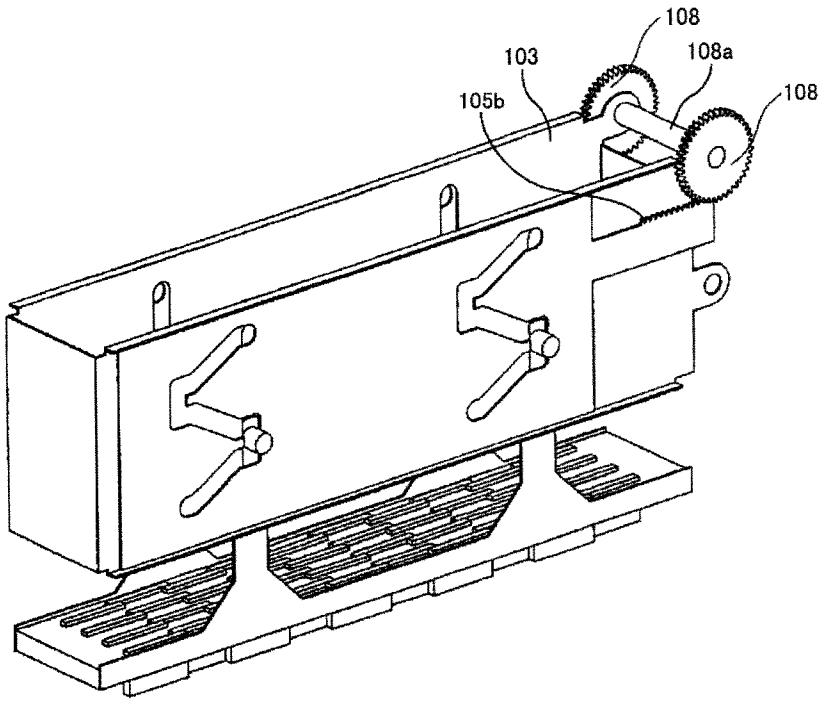
FIG. 12 is a perspective view of a configuration including first pinion gears added to the configuration of FIG. 11.

The first cam gap 105*a* includes a first slope gap 1051*a* that is a slope part rising from the left to the right (rack gear forming side) as viewed in FIG. 12, and a first vertical gap 1052*a* that is a parallel part extending vertically and connecting to the topmost part of the first slope gap 1051*a*. Furthermore, the first cam gap 105*a* includes a second slope gap 1051*b* rising from the right to the left as viewed in FIG. 12 and connecting to the topmost part of the first vertical gap 1052*a*, a second vertical gap 1052*b* extending vertically and connecting to the topmost part of the second slope gap 1051*b*, and a third slope gap 1051*c* rising from the left to the right as viewed in FIG. 12 and connecting to the topmost part of the second vertical gap 1052*b*. Furthermore, on the right edge of each of the first translation cams 105, a first rack gear 105*b* is provided.

FIG. 12 is a perspective view of a configuration including the first pinion gears 108 added to the configuration of FIG. 11.

As shown in FIG. 12, the first pinion gears 108 are in mesh-engagement with the first rack gears 105*b* of the first translation cams 105. The first pinion gears 108 are fixed to the first rotating shaft 108*a* that is rotatably supported in the first supporting holes 103*b* of the frame 103. A driving gear (not shown) connected to a driving motor is in mesh-engagement with the first pinion gears 108 at the back as viewed in FIG. 12.

Figure 13:
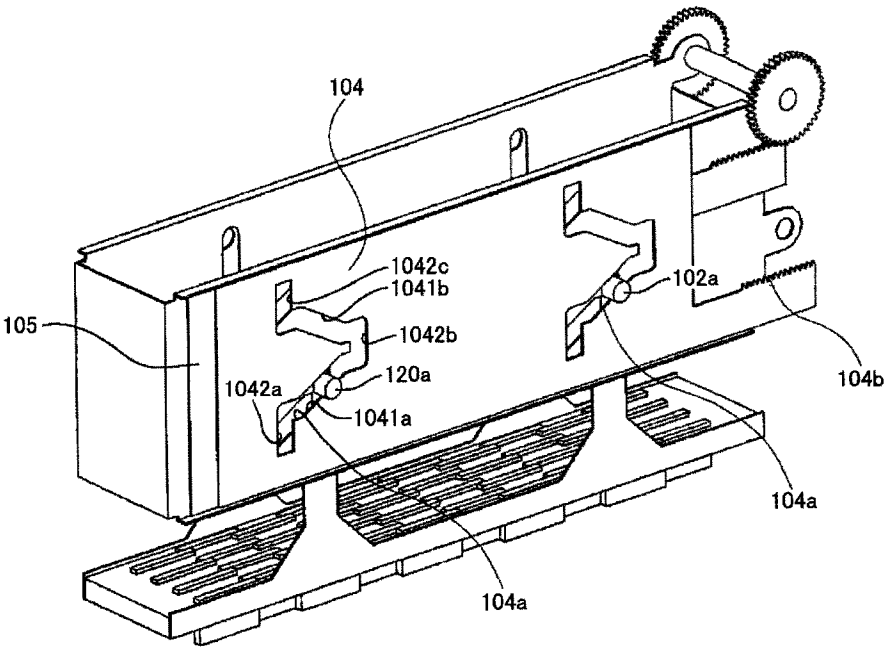
FIG. 13 is a perspective view of a configuration including a pair of second translation cams added to the configuration of FIG. 12.

FIG. 13 is a perspective view of a configuration including the pair of second translation cams 104 added to the configuration of FIG. 12.

As shown in FIG. 13, the second translation cams 104 are shaped as a plate, and are provided at the first translation cam 105 at the back side and the first translation cam 105 at the front side as viewed in FIG. 13, in a manner as to face each other.

At one end and another end of each of the second translation cams 104 in the longitudinal direction, the move-use pins 102*a* are inserted, and second cam gaps 104*a* are formed as holes in which the move-use pins 102*a* can relatively move.

The second cam gap 104*a* includes a first vertical gap 1042*a* that is a parallel part extending vertically, and a first slope gap 1041*a* that is a slope part rising from the left to the right (rack gear forming side) as viewed in FIG. 13 and connecting to the topmost part of the first vertical gap 1042*a*. Furthermore, the second cam gap 104*a* includes a second vertical gap 1042*b* extending vertically and connecting to the topmost part of the second vertical gap 1042*b*, a second slope gap 1041*b* rising from the right to the left as viewed in FIG. 13 and connecting to the topmost part of the second vertical gap 1042*b*, and a third vertical gap 1042*c* extending vertically and connecting to the topmost part of the second slope gap 1041*b*.

As described above, in the second cam gaps 104*a* of the pair of second translation cams 104, vertical gaps and slope gaps are alternately formed from the bottom. Meanwhile, in the first cam gaps 105*a* of the pair of first translation cams 105, slope gaps and vertical gaps are alternately formed from the bottom, which is in a reverse manner with respect to the second cam gaps 104*a*. Furthermore, on the right edge of each of the second translation cams 104, a second rack gear 104*b* is provided.

Figure 14:
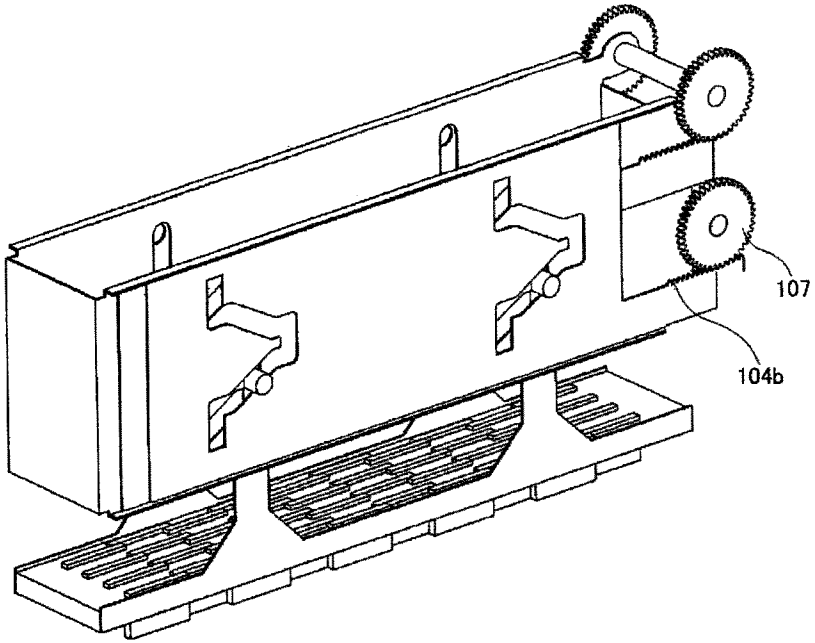
FIG. 14 is a perspective view of a configuration including second pinion gears added to the configuration of FIG. 13.

FIG. 14 is a perspective view of a configuration including the second pinion gears 107 added to the configuration of FIG. 13.

As shown in FIG. 14, the second pinion gears 107 are in mesh-engagement with the second rack gears 104*b* of each second translation cams 104. The second pinion gears 107 are fixed to the second rotating shaft 107*a* that is rotatably supported in the second supporting holes 103*c* of the frame 103. A driving gear (not shown) connected to a driving motor is in mesh-engagement with the second pinion gears 107 at the back as viewed in FIG. 14.

Next, a description is given of an elevating operation of the elevating mechanism 110 according to the present embodiment with reference to FIGS. 15A through 17B.

Figure 15A:
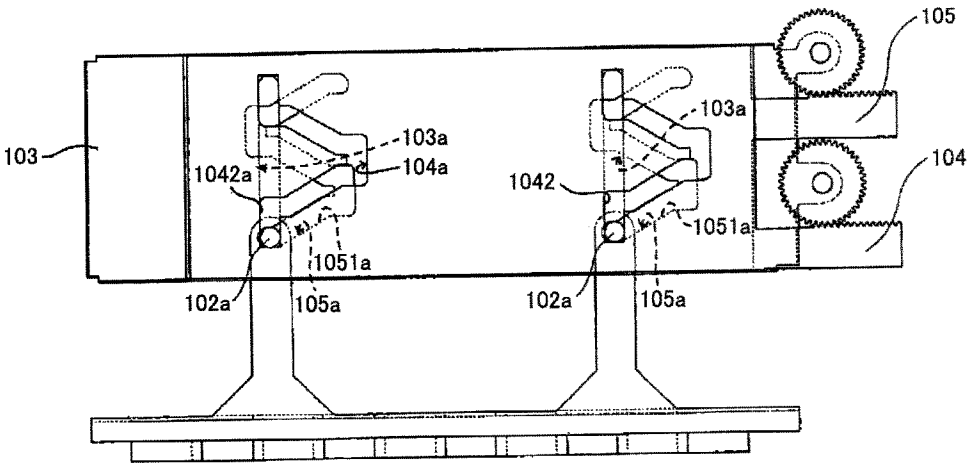
FIGS. 15A through 15C illustrate an elevating operation of an elevating mechanism.

FIG. 15A illustrates the head part 40 being positioned at the height for printing on plain paper indicated in FIG. 6. As shown in FIG. 15A, when the head part 40 is positioned at a height for printing on plain paper, the move-use pin 102*a* is positioned at the bottommost part of the first slope gap 1051*a* of the first cam gap 105*a*, and at the bottommost part of the first vertical gap 1042*a* of the second cam gap 104*a*.

Figure 15B:
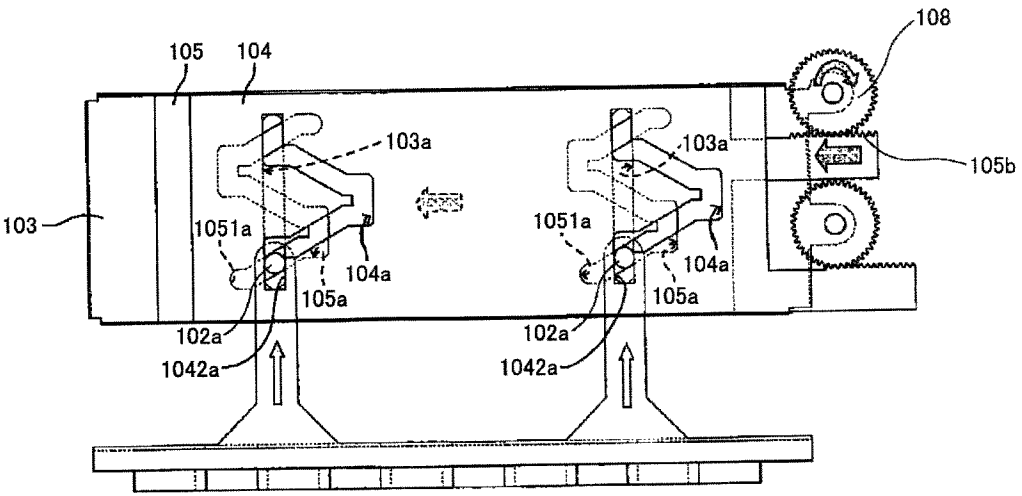

From this state, as shown in FIG. 15B, the first pinion gears 108 are rotated in a clockwise direction as viewed in FIG. 15B and the first translation cams 105 are moved in the left direction as viewed in FIG. 15B. Accordingly, the move-use pin 102*a* relatively moves by being guided in the first slope gap 1051*a* of the first cam gap 105*a*. Furthermore, the move-use pin 102*a* relatively moves upward in the first vertical gap 1042*a* of the second cam gap 104*a* and the guide hole 103*a* of the frame 103. Accordingly, the head part 40 moves upward.

As described above, in the present embodiment, when the move-use pin 102*a* is positioned in the first slope gap 1051*a* of the first cam gap 105*a*, the move-use pin 102*a* is positioned in the first vertical gap 1042*a* of the second cam gap 104*a* of the second translation cam 104 that is the other translation cam. Thus, when the first translation cams 105 are moved and the move-use pin 102*a* is relatively moving in the first slope gap 1051*a* of the first cam gap 105*a*, the move-use pin 102*a* relatively moves in the first vertical gap 1042*a* of the second cam gap 104*a* of the second translation cam 104 that is stopped. Accordingly, the move-use pin 102*a* can move upward by being guided in the first slope gap 1051*a* of the first cam gap 105*a*, and the head part 40 can be raised.

Figure 15C:
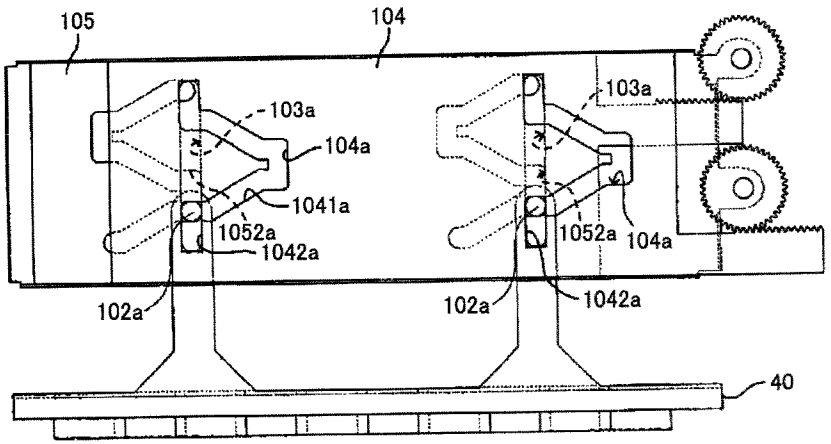

Then, as shown in FIG. 15C, when the move-use pin 102*a* moves to the bottommost part of the first vertical gap 1052*a* of the first cam gap 105*a*, the move-use pin 102*a* moves to the part connecting the first vertical gap 1042*a* and the first slope gap 1041*a* of the second cam gap 104*a*. When the move-use pin 102*a* relatively moves to this position, the rotation of the first pinion gears 108 is stopped, so that the head part 40 stops at the position of the height for printing on cardboard indicated in FIG. 6.

In the present embodiment, from the state of FIG. 15C, when an attempt is made to move the first translation cams 105 to the left side as viewed in FIG. 15C by rotating the first pinion gears 108 in the clockwise direction, the move-use pin 102*a* hits the side surface on the rack gear side of the first vertical gap 1052*a*, and therefore the move-use pin 102*a* does not further move relatively in the first cam gap 105*a*. Accordingly, even when there is a certain amount of delay in stopping the driving motor driving the first pinion gears 108, or when the driving motor and the first pinion gears 108 rotate by a certain amount due to inertia after the driving motor is stopped, the head part 40 can be precisely positioned at the height for printing on cardboard. Therefore, images can be properly formed on cardboard.

Figure 16A:
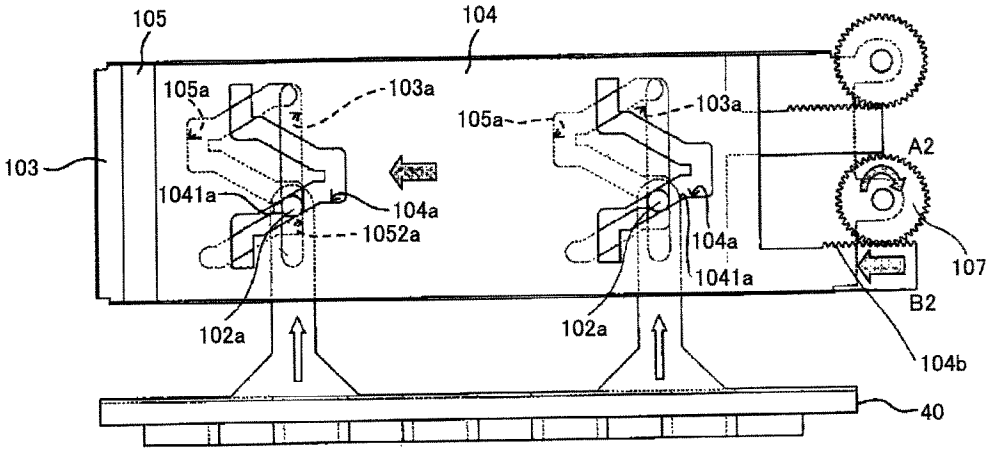
FIGS. 16A through 16C are continued from FIGS. 15A through 15C illustrating the elevating operation.

Next, as shown in FIG. 16A, the second pinion gears 107 are rotated in a clockwise direction as viewed in FIG. 16A and the second translation cams 104 are moved in the left direction as viewed in FIG. 16A. Accordingly, the move-use pin 102*a* relatively moves by being guided in the first slope gap 1041*a* of the second cam gap 104*a*. Furthermore, the move-use pin 102*a* relatively moves upward in the first vertical gap 1052*a* of the first cam gap 105*a* and the guide hole 103*a* of the frame 103. Accordingly, the head part 40 further moves upward from the height for printing on cardboard.

As described above, when the move-use pin 102*a* is positioned in the first slope gap 1041*a* of the second cam gap 104*a*, the move-use pin 102*a* is positioned in the first vertical gap 1052*a* of the first cam gap 105*a* of the first translation cam 105 that is the other translation cam. Thus, when the second translation cams 104 are moved and the move-use pin 102*a* is relatively moving in the first slope gap 1041*a* of the second cam gap 104*a*, the move-use pin 102*a* relatively moves in the first vertical gap 1052*a* of the first cam gap 105*a* of the first translation cam 105 that is stopped. Accordingly, the move-use pin 102*a* can move upward by being guided in the first slope gap 1041*a* of the second cam gap 104*a*, and the head part 40 can be raised.

Figure 16B:
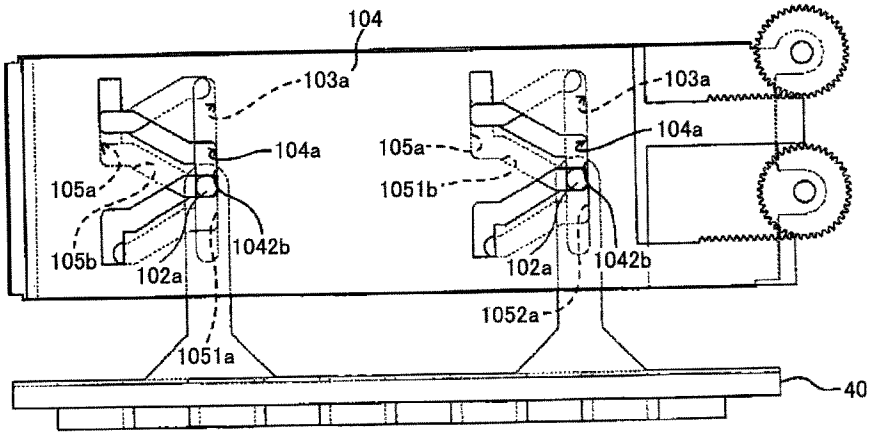

Then, as shown in FIG. 16B, when the move-use pin 102*a* moves to the bottommost part of the second vertical gap 1042*b* of the second cam gap 104*a*, the move-use pin 102*a* moves to the part connecting the first vertical gap 1052*a* and the second slope gap 1051*b* of the first cam gap 105*a*. When the move-use pin 102*a* relatively moves to this position, the rotation of the second pinion gears 107 is stopped.

At this time also, from the state of FIG. 16B, when an attempt is made to move the second translation cams 104 to the left side as viewed in FIG. 16B by rotating the second pinion gears 107 in the clockwise direction, the move-use pin 102*a* hits the side surface on the rack gear side of the second vertical gap 1042*b*, and therefore the move-use pin 102*a* does not further move relatively in the second cam gap 104*a*. Accordingly, without the need of controlling the second translation cam 104 to stop precisely, the head part 40 can be precisely positioned at the height for printing on a paper bag. Therefore, images can be properly formed on a paper bag.

Figure 16C:
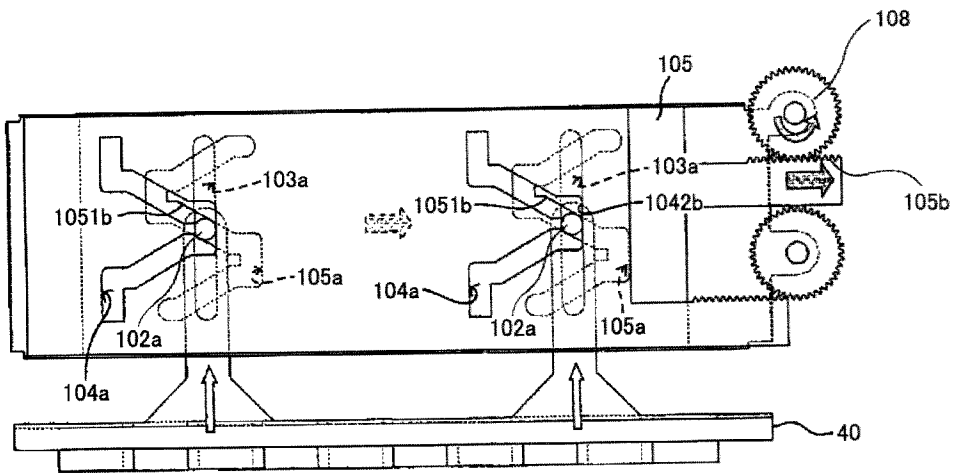

Next, as shown in FIG. 16C, the first pinion gears 108 are rotated in a counterclockwise direction and the first translation cams 105 are moved in the right direction as viewed in FIG. 16C. Accordingly, the move-use pin 102*a* relatively moves in the second slope gap 1051*b* of the first cam gap 105*a* and relatively moves in the second vertical gap 1042*b* of the second cam gap 104*a*. Accordingly, the head part 40 further moves upward from the height for printing on a paper bag.

Figure 17A:
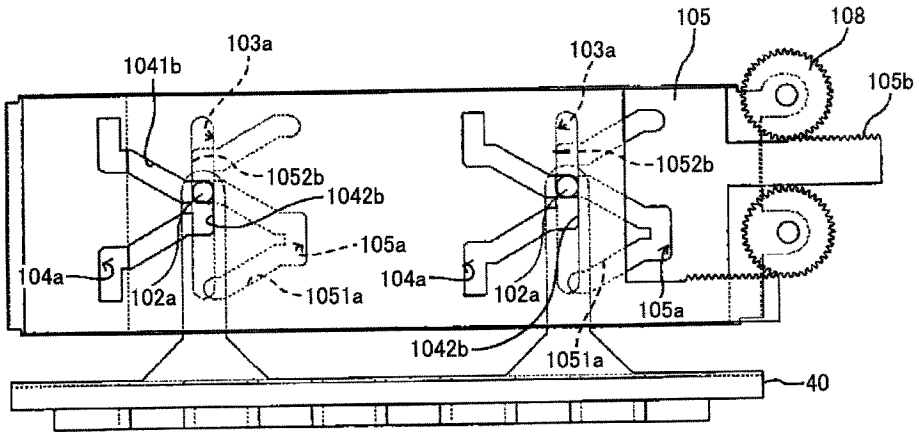
FIGS. 17A and 17B are continued from FIGS. 16A through 16C illustrating the elevating operation.

Then, as shown in FIG. 17A, when the move-use pin 102*a* relatively moves to the bottommost part of the second vertical gap 1052*b* of the first cam gap 105*a*, and the move-use pin 102*a* relatively moves to the part connecting the second vertical gap 1042*b* and the second slope gap 1041*b* of the second cam gap 104*a*, the rotation of the first pinion gears 108 is stopped. Accordingly, the head part 40 is positioned at the cap height indicated in FIG. 6. Thus, similar to the above, without the need of controlling the first pinion gears 108 to stop precisely, the head part 40 can be precisely positioned at the cap height. Therefore, the cap suction operation can be properly performed and the nozzles can be maintained in a moist state.

As described above, by providing plural slope gaps in the first cam gap 105*a* of the first translation cam 105, the head part 40 can be moved in plural stages with the first translation cam 105 (moved between the height for printing on plain paper and the height for printing on cardboard, and moved between the height for printing on a paper bag and the cap height). Therefore, the number of components can be reduced. Furthermore, by making the second slope gap 1051*b* have a slope direction that is different from that of the first slope gap 1051*a*, the first translation cam 105 can be moved in a direction opposite to the previous movement direction. Accordingly, the head part 40 can be raised. As described above, by moving the first translation cam 105 in a direction opposite to the previous movement direction, the head part 40 can be raised by plural stages. Therefore, the length of the first rack gear 105*b* can be reduced, and the first translation cam 105 can be made compact.

Figure 17B:
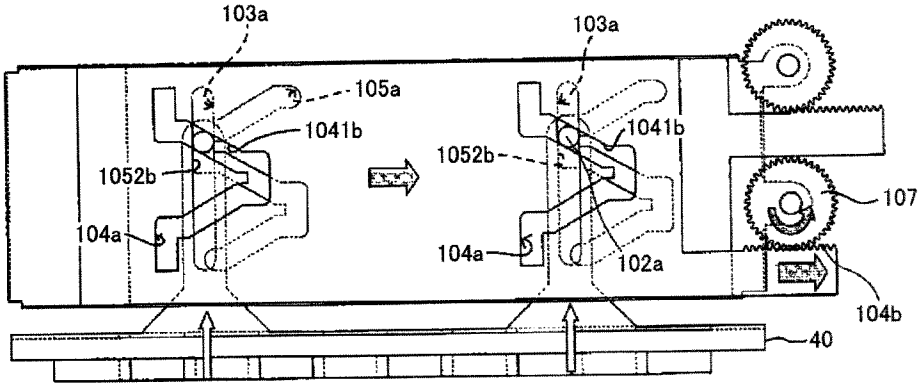

Next, as shown in FIG. 17B, the second pinion gears 107 are rotated in a counterclockwise direction and the second translation cams 104 are moved in the right direction as viewed in FIG. 17B. Accordingly, the move-use pin 102*a* relatively moves in the second slope gap 1041*b* of the second cam gap 104*a* and relatively moves in the second vertical gap 1052*b* of the first cam gap 105*a*. Accordingly, the head part 40 further moves upward from the cap height. Furthermore, although not shown, when the move-use pin 102*a* relatively moves to the bottommost part of the third vertical gap 1042*c* of the second cam gap 104*a*, and the move-use pin 102*a* relatively moves to the part connecting the second vertical gap 1052*b* and the third slope gap 1051*c* of the first cam gap 105*a*, the rotation of the second pinion gears 107 is stopped. Accordingly, the head part 40 is positioned at the wiping height indicated in FIG. 6. Accordingly, similar to the above, without the need of controlling the second pinion gears 107 to stop precisely, the head part 40 can be precisely positioned at the wiping height. Therefore, the nozzle surfaces can be properly wiped by wiper blades.

Next, although not shown, the first pinion gears 108 are rotated in a clockwise direction and the first translation cams 105 are moved in the right direction. Accordingly, the move-use pin 102*a* relatively moves to the topmost part of the third slope gap 1051*c* of the first cam gap 105*a* and relatively moves to the topmost part of the third vertical gap 1042*c* of the second cam gap 104*a*. Thus, the head part 40 moves from the wiping position to the withdrawn height indicated in FIG. 6.

As described above, by providing plural slope gaps in the second cam gap 104*a* of the second translation cam 104, the head part 40 can be precisely moved in plural stages only with the first translation cam 105 and the second translation cam 104, and therefore the number of components can be reduced. Furthermore, in the second translation cam 104 also, by making the second slope gap 1041*b* have a slope direction that is different from that of the first slope gap 1041*a*, the second translation cam 104 can be moved in a direction opposite to the previous movement direction. Accordingly, the head part 40 can be raised. As described above, by moving the second translation cam 104 in a direction opposite to the previous movement direction, the head part 40 can be raised by plural stages. Therefore, the length of the second rack gear 104*b* can be reduced, and the second translation cam 104 can be made compact.

In the present embodiment, the following relationships are constantly maintained. That is, when the move-use pin 102*a* acting as a protruding part is positioned in the slope gap of the first cam gap 105*a*, the move-use pin 102*a* is positioned in the vertical gap of the second cam gap 104*a*. When the move-use pin 102*a* is positioned in the slope gap of the second cam gap 104*a*, the move-use pin 102*a* is positioned in the vertical gap of the first cam gap 105*a*. In this manner, the following relationship is constantly maintained. That is, when the move-use pin 102*a* is positioned in the slope gap of a cam gap of a certain translation cam, the move-use pin 102*a* is positioned in the vertical gap of a cam gap of the other translation cam. Accordingly, only by moving the translation cam in which the move-use pin 102*a* is positioned in a slope gap, the move-use pin 102*a* rises, and therefore the head part 40 can be raised in plural stages.

Next, a description is given of a modification of the elevating mechanism 110.

Modification 1

Figure 18:
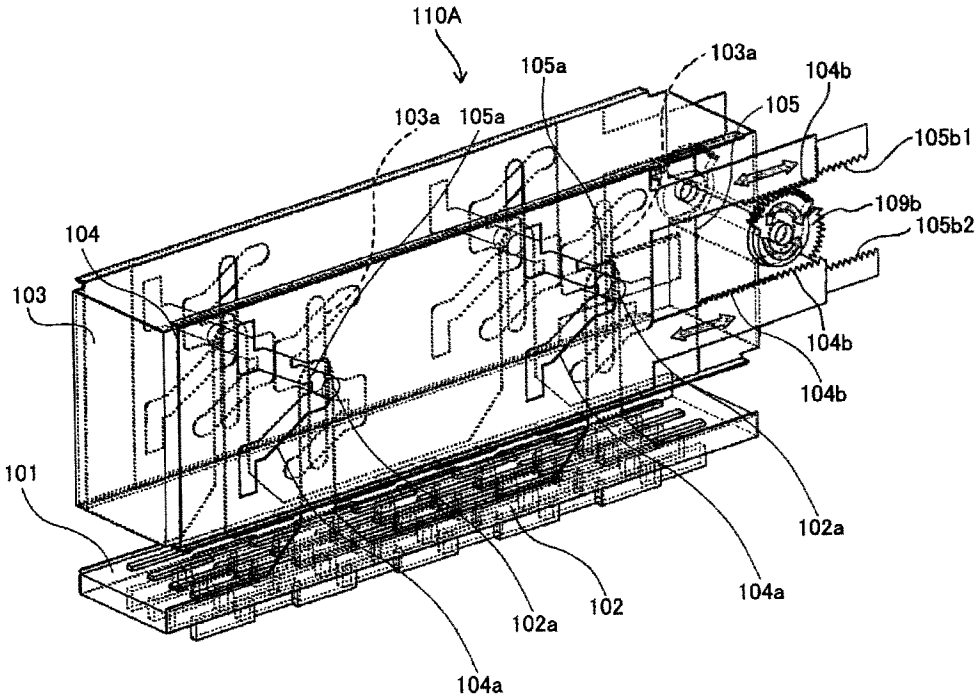
FIG. 18 is a perspective view of an elevating mechanism according to modification 1.
Figure 19:
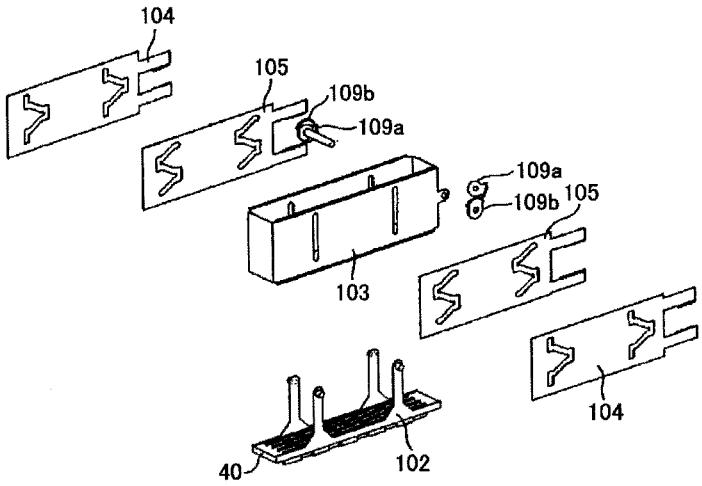
FIG. 19 is an exploded perspective view of the elevating mechanism according to modification 1.

FIG. 18 is a perspective view of an elevating mechanism 110A according to modification 1, and FIG. 19 is an exploded perspective view of the elevating mechanism 110A according to modification 1.

In modification 1, a single motor causes the first translation cam 105 and the second translation cam 104 to move back and forth (reciprocate).

Figure 20:
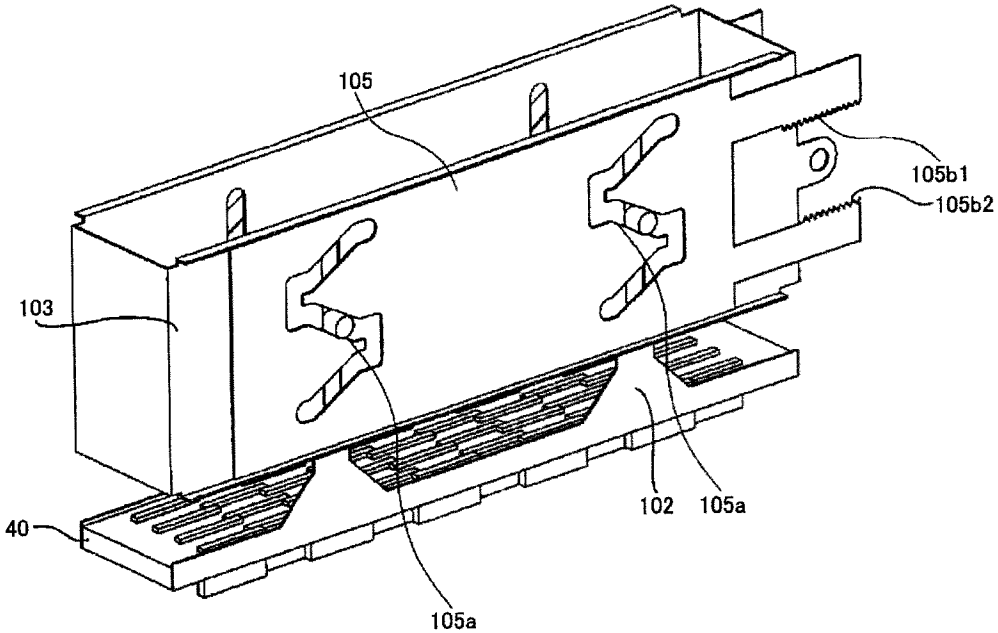
FIG. 20 is a perspective view of the first translation cam of the elevating mechanism according to modification 1, shown together with the frame, the head brackets, and the head part.

FIG. 20 is a perspective view of the first translation cam 105 of the elevating mechanism 110A according to modification 1, shown together with the frame 103, the head brackets 102, and the head part 40.

As shown in FIG. 20, the elevating mechanism 110A according to modification 1 includes a first front moving rack gear 105*b*2 and a first back moving rack gear 105*b*1 on the right side edge part of the first translation cam 105 as viewed in FIG. 20. The first front moving rack gear 105*b*2 is provided so as to face the first back moving rack gear 105*b*1.

Figure 21:
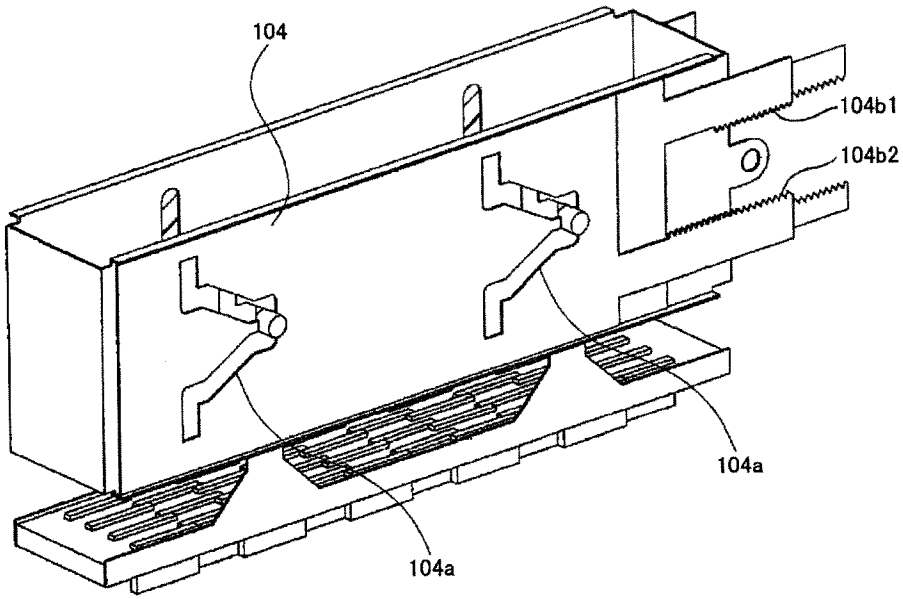
FIG. 21 is a perspective view of a configuration including the second translation cam added to the configuration of FIG. 20.

FIG. 21 is a perspective view of a configuration including the second translation cam 104 added to the configuration of FIG. 20. As shown in FIG. 21, the second translation cam 104 also has a second front moving rack gear 104*b*2 and a second back moving rack gear 104*b*1 facing the second front moving rack gear 104*b*2.

Figure 22:
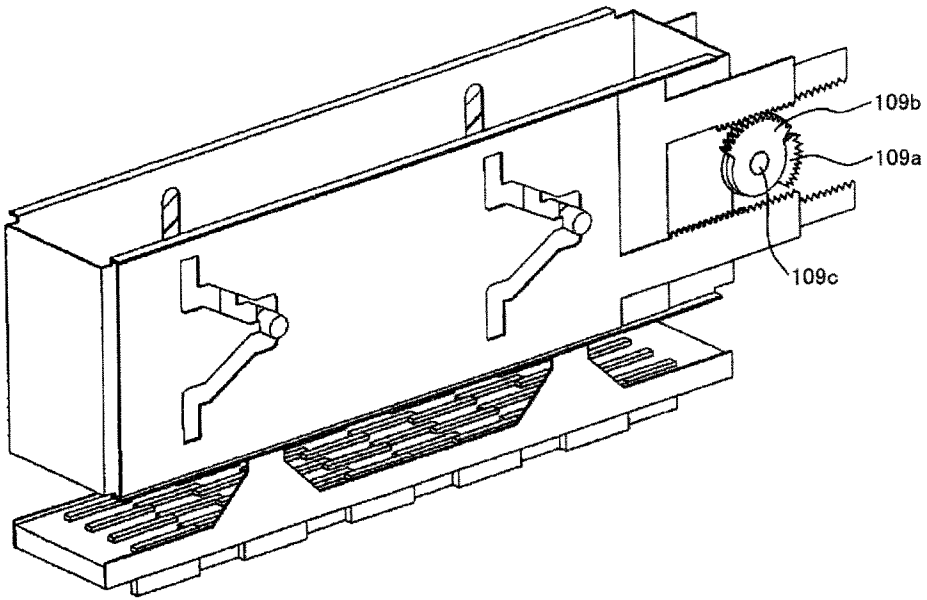
FIG. 22 is a perspective view of a configuration including a first intermittent gear and a second intermittent gear added to the configuration of FIG. 21.

FIG. 22 is a perspective view of a configuration including a first intermittent gear 109*a* and a second intermittent gear 109*b* added to the configuration of FIG. 21.

As shown in FIG. 22, the first intermittent gear 109*a* and the second intermittent gear 109*b* are fixed to the same rotating shaft 109*c*. The first intermittent gear 109*a* is attached to a position to be in mesh-engagement with the first front moving rack gear 105*b*2 and the first back moving rack gear 105*b*1. The second intermittent gear 109*b* is attached to a position to be in mesh-engagement with the second front moving rack gear 104*b*2 and the second back moving rack gear 104*b*1.

Furthermore, the gear part of the first intermittent gear 109*a* and the gear part of the second intermittent gear 109*b* are formed within a range of less than 90 degrees in the rotating direction. Furthermore, the first intermittent gear 109*a* and the second intermittent gear 109*b* are attached to the rotating shaft 109*c* in such a manner that the gear part of the second intermittent gear 1096 is displaced by a phase of 90 degrees with respect to the gear part of the first intermittent gear 109*a*.

When the head part 40 is at a position for printing on plain paper, the first intermittent gear 109*a* is in mesh-engagement with the first front moving rack gear 105*b*2. When the rotating shaft 109*c* is rotated in the clockwise direction, the first translation cam 105 moves toward the right as viewed in FIG. 22, similar to the case indicated in FIG. 15B. When the rotating shaft 109*c* is rotated by 90 degrees in the clockwise direction, the move-use pin 102*a* is positioned at the position indicated in FIG. 15C, and the head part 40 is positioned at a position for printing on cardboard. At this time, the mesh-engagement of the first intermittent gear 109*a* and the first front moving rack gear 105*b*2 is released, and the first translation cam 105 stops moving.

From this state, when the rotating shaft 109*c* is further rotated in the clockwise direction, the second intermittent gear 109*b* and the second front moving rack gear 104*b*2 come in mesh-engagement with each other, and the second translation cam 104 moves to the right side as viewed in FIG. 22, similar to the case indicated in FIG. 16A. Then, when the rotating shaft 109*c* is further rotated by 90 degrees, the move-use pin 102*a* reaches the position indicated in FIG. 16B, the mesh-engagement of the second intermittent gear 109*b* and the second front moving rack gear 104*b*2 is released, and the second translation cam 104 stops moving.

From this state, when the rotating shaft 109*c* is further rotated in the clockwise direction, the first intermittent gear 109*a* and the first back moving rack gear 105*b*1 come in mesh-engagement with each other, and the first translation cam 105 moves to the right side as viewed in FIG. 22, similar to the case indicated in FIG. 16C. Then, when the rotating shaft 109*c* is further rotated by 90 degrees, the move-use pin 102*a* reaches the position indicated in FIG. 17A, the mesh-engagement of the first intermittent gear 109*a* and the first back moving rack gear 105*b*1 is released, and the first translation cam 105 stops moving.

From this state, when the rotating shaft 1090 is further rotated in the clockwise direction, the second intermittent gear 109*b* and the second back moving rack gear 104*b*1 come in mesh-engagement with each other, and the second translation cam 104 moves to the right side as viewed in FIG. 22, similar to the case indicated in FIG. 17B. Then, when the rotating shaft 109*c* is further rotated by 90 degrees, the move-use pin 102*a* relatively moves to the bottommost part of the third vertical gap 1042*c* of the second cam gap 104*a*, and relatively moves to the part connecting the second vertical gap 1052*b* and the third slope gap 1051*c* of the first cam gap 105*a*. Furthermore, the mesh-engagement of the second intermittent gear 109*b* and the second back moving rack gear 104*b*1 is released, and the second translation cam 104 stops moving. Subsequent movements are the same as the case of moving the head part 40 from the position for printing on plain paper to the position for printing on cardboard.

By the configuration described above, a single motor can be used to alternately move the first translation cam 105 and the second translation care 104 and cause a reciprocating movement. Accordingly, cost of the device can be reduced.

Modification 2

Figure 23:
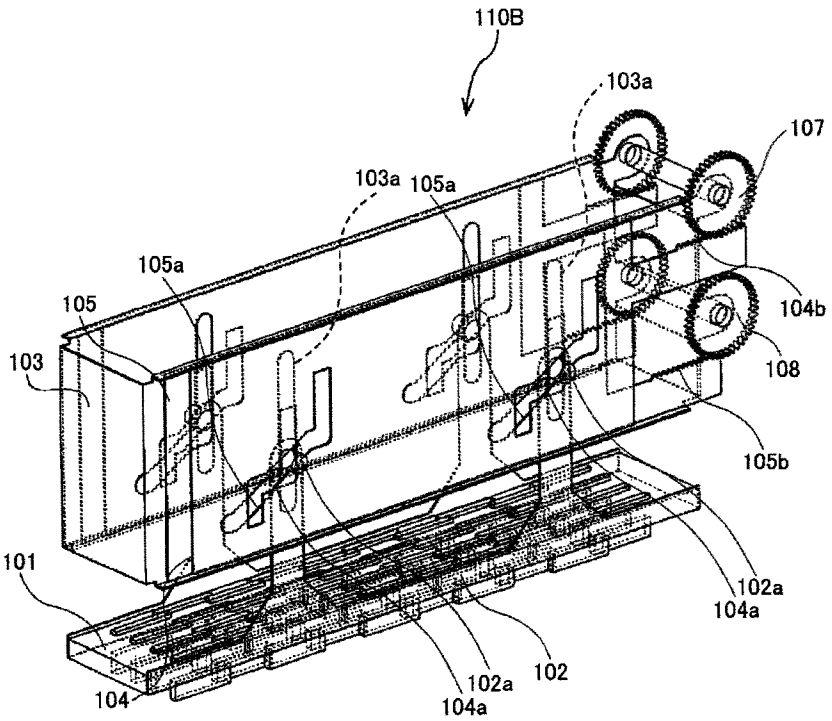
FIG. 23 is a perspective view of an elevating mechanism according to modification 2.
Figure 24:
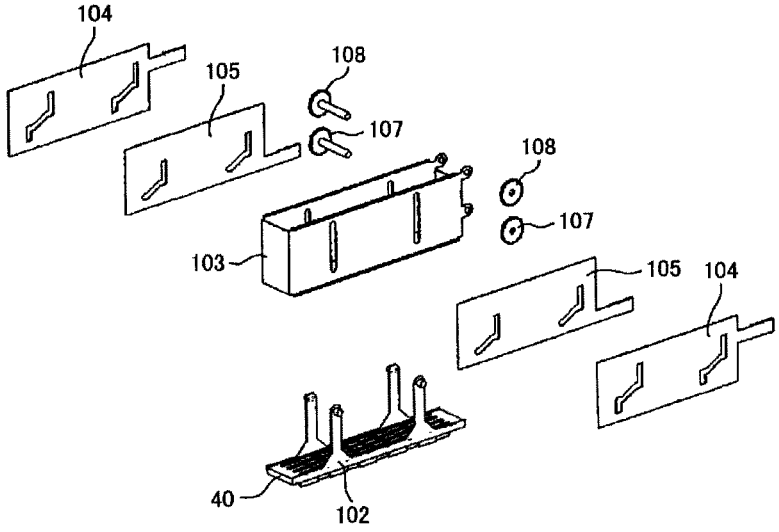
FIG. 24 is an exploded perspective view of the elevating mechanism according to modification 2.

FIG. 23 is a perspective view of an elevating mechanism 110B according to modification 2, and FIG. 24 is an exploded perspective view of the elevating mechanism 110B according to modification 2.

In modification 2, the first cam gaps 105*a* and the second cam gaps 104*a* of the elevating mechanism 110 according to the above embodiment are deformed. With such an elevating mechanism 110, the head part 40 is elevated to a position for printing on a paper bag, instead of to a position for printing an plain paper as indicated in FIG. 6.

Figure 25:
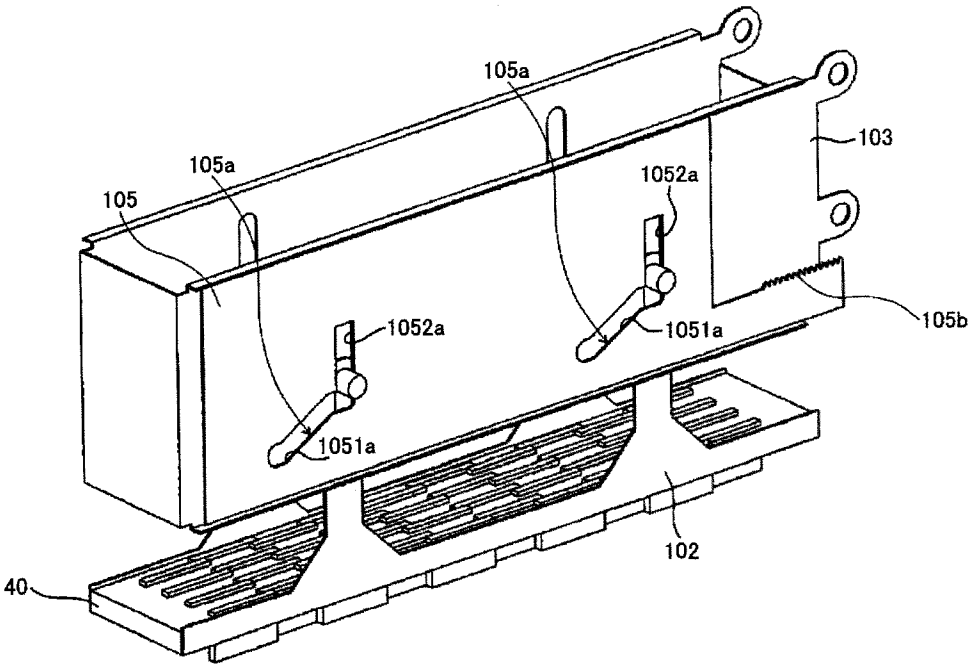
FIG. 25 is a perspective view of the first translation cam of the elevating mechanism according to modification 2, shown together with the frame, the head brackets, and the head part.

FIG. 25 is a perspective view of the first translation cam 105 of the elevating mechanism 110B, shown together with the frame 103, the head brackets 102, and the head part 40.

As shown in FIG. 25, the first cam gap 105*a* of the first translation cam 105 includes, starting from the bottom edge, the first slope gap 1051*a* that rises from the left to the right as viewed in FIG. 23, and the first vertical gap 1052*a*.

Figure 26:
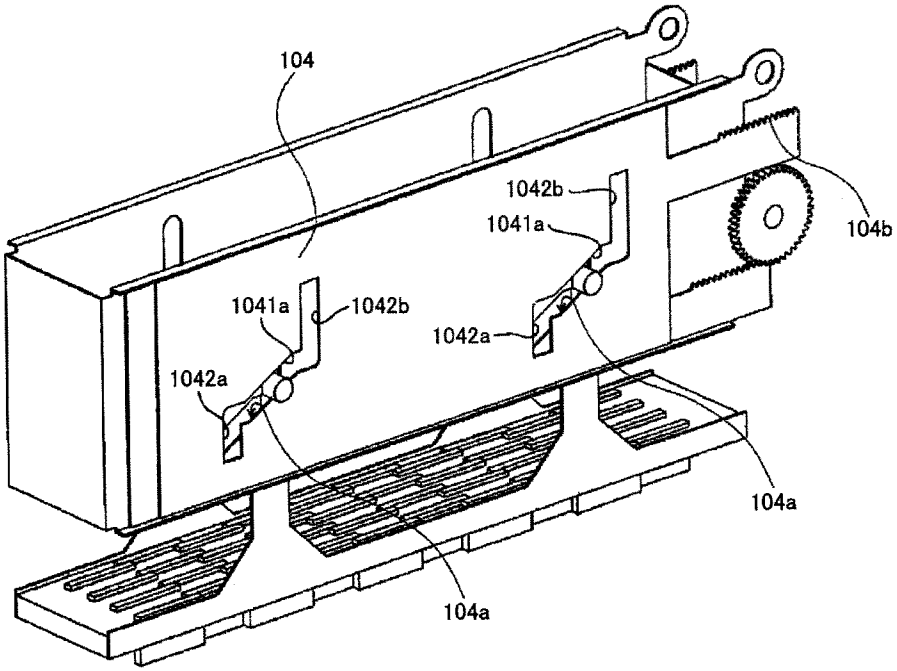
FIG. 26 is a perspective view of a configuration including the second translation cam added to the configuration of FIG. 25.

FIG. 26 is a perspective view of a configuration including the second translation cam 104 added to the configuration of FIG. 25.

As shown in FIG. 26, the second cam gap 104*a* of the second translation cam 104 includes, starting from the bottom edge, the first vertical gap 1042*a*, the first slope gap 1041*a* that rises from the left to the right as viewed in FIG. 26, and the second vertical gap 1042*b*.

Furthermore, in modification 2, unlike the above embodiment, the first rack gear 105*b* is positioned below the second rack gear 104*b*.

FIGS. 27A through 28B illustrate an elevating operation of the elevating mechanism 110B according to modification 2.

Figure 27A:
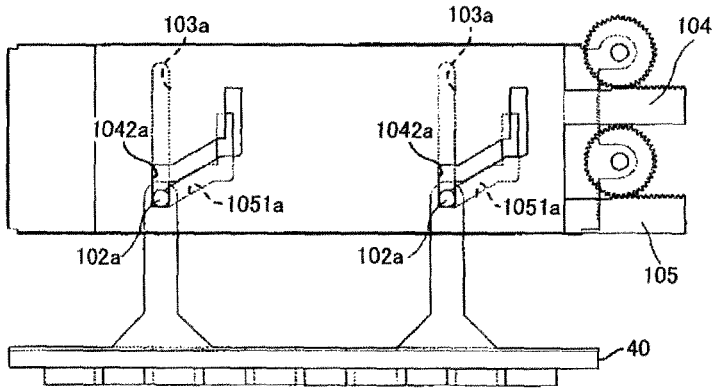
FIGS. 27A through 27C illustrate an elevating operation of the elevating mechanism according to modification 2.

As shown in FIG. 27A, when the head part 40 is positioned at a height for printing on plain paper, the move-use pin 102*a* is positioned at the bottommost part of the first slope gap 1051*a* of the first cam gap 105*a*, and at the bottommost part of the first vertical gap 1042*a* of the second cam gap 104*a*.

Figure 27B:
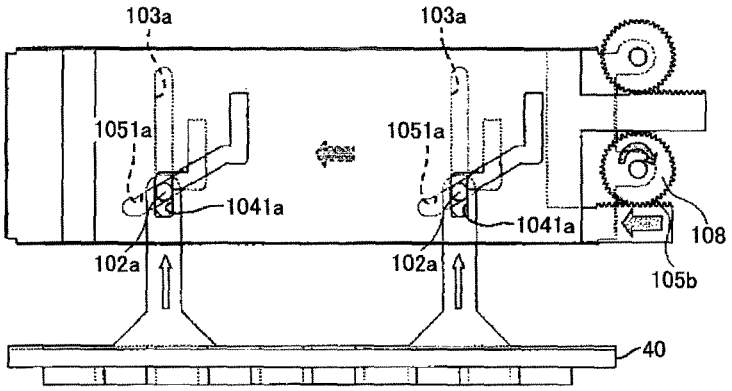

From this state, as shown in FIG. 27B, the first pinion gears 108 are rotated in a clockwise direction as viewed in FIG. 27B and the first translation cams 105 are moved in the left direction as viewed in FIG. 27B. Accordingly, the move-use pin 102*a* relatively moves by being guided in the first slope gap 1051*a* of the first cam gap 105*a*. Furthermore, the move-use pin 102*a* relatively moves upward in the first vertical gap 1042*a* of the second cam gap 104*a* and the guide hole 103*a* of the frame 103. Accordingly, the head part 40 moves upward.

Figure 27C:
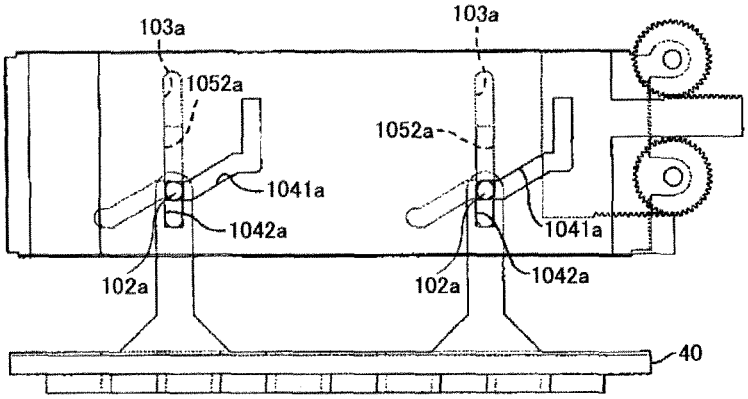

Then, as shown in FIG. 27C, when the move-use pin 102*a* moves to the bottommost part of the first vertical gap 1052*a* of the first cam gap 105*a*, the move-use pin 102*a* moves to the part connecting the first vertical gap 1042*a* and the first slope gap 1041*a* of the second cam gap 104*a*. When the move-use pin 102*a* relatively moves to this position, the rotation of the first pinion gears 108 is stopped, so that the head part 40 stops at the position of the height for printing on cardboard.

Figure 28A:
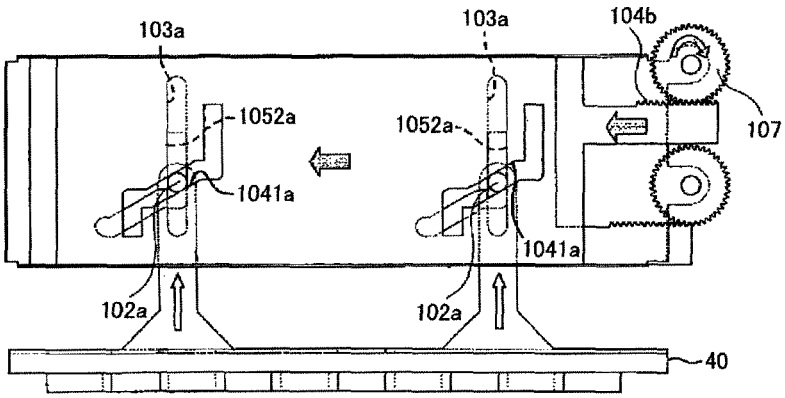
FIGS. 28A and 28B are continued from FIGS. 27A through 27C illustrating the elevating operation.

Next, as shown in FIG. 28A, the second pinion gears 107 are rotated in a clockwise direction as viewed in FIG. 28A and the second translation cams 104 are moved in the left direction as viewed in FIG. 28A. Accordingly, the move-use pin 102*a* relatively moves by being guided in the first slope gap 1041*a* of the second cam gap 104*a*. Furthermore, the move-use pin 102*a* relatively moves upward in the first vertical gap 1052*a* of the first cam gap 105*a* and the guide hole 103*a* of the frame 103. Accordingly, the head part 40 further moves upward from the height for printing on cardboard.

Figure 28B:
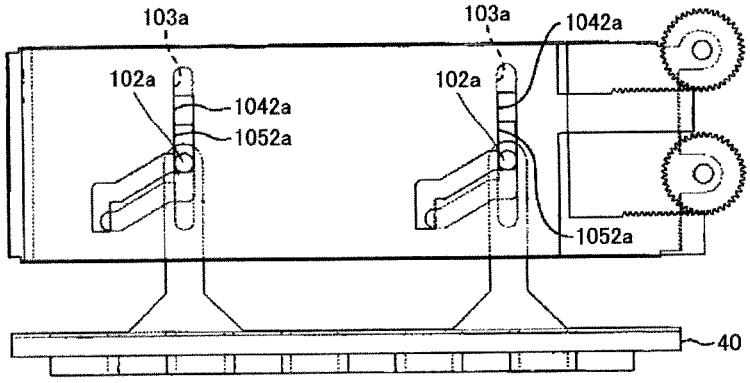

Then, as shown in FIG. 28B, when the move-use pin 102*a* moves to the bottommost part of the second vertical gap 1042*b* of the second cam gap 104*a*, the move-use pin 102*a* moves to the part connecting the first vertical gap 1052*a* and the second slope gap 1051*b* of the first cam gap 105*a*. When the move-use pin 102*a* relatively moves to this position, the rotation of the second pinion gears 107 is stopped. Accordingly, the head part 40 stops at the height for printing on a paper bag.

Also in modification 2, the following relationships are constantly maintained. That is, when the move-use pin 102*a* acting as a protruding part is positioned in the slope gap of the first cam gap 105*a*, the move-use pin 102*a* is positioned in the vertical gap of the second cam gap 104*a*. When the move-use pin 102*a* is positioned in the slope gap of the second cam gap 104*a*, the move-use pin 102*a* is positioned in the vertical gap of the first cam gap 105*a*. Accordingly, only by moving the translation cam in which the move-use pin 102*a* is positioned in a slope gap, the move-use pin 102*a* rises, and therefore the head part 40 can be raised in plural stages.

In modification 2, the head part 40 moves between two elevation stages (printing on plain paper and printing on a paper bag). However, the number of elevation stages may be increased by increasing the number of translation cams.

Figure 29A:
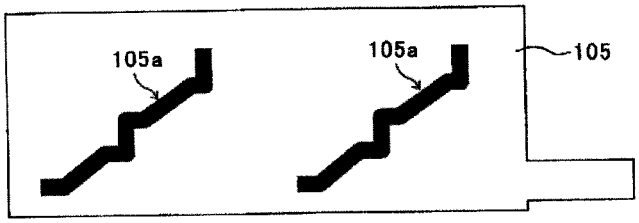
FIGS. 29A and 29B illustrate the first translation cam and the second translation cam of the elevating mechanism according to modification 2 that can elevate between four stages with two translation cams.
Figure 29B:
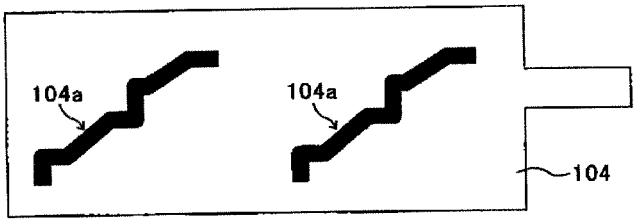

Furthermore, as shown in FIGS. 29A and 29B, by constituting the first cam gap 105*a* of the first translation cam 105 and the second cam gap 104*a* of the second translation cam 104 to have plural combinations of vertical gaps and slope gaps, two translation cams can be used for elevating between two or more stages.

Modification 3

Figure 30:
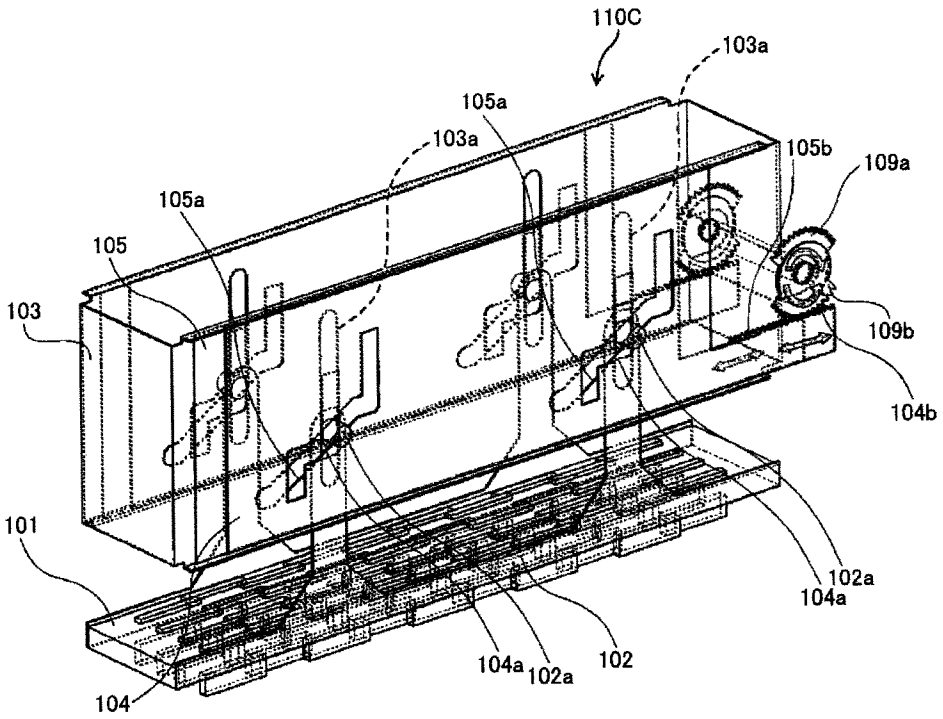
FIG. 30 is a schematic perspective view of an elevating mechanism according to modification 3.
Figure 31:
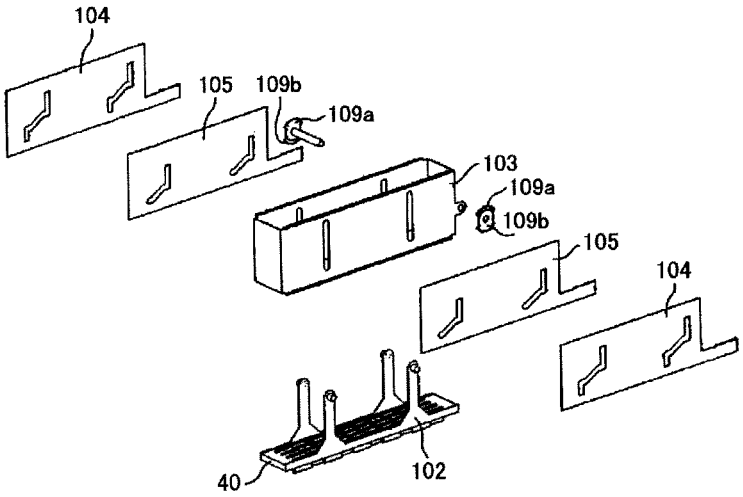
FIG. 31 is an exploded perspective view of the elevating mechanism according to modification 3.

FIG. 30 is a schematic perspective view of an elevating mechanism 110C according to modification 3, and FIG. 31 is an exploded perspective view of the elevating mechanism 110C according to modification 3.

In modification 3, a single driving motor is used to drive the first translation cam 105 and the second translation cam 104 of the elevating mechanism according to modification 2.

Figure 32:
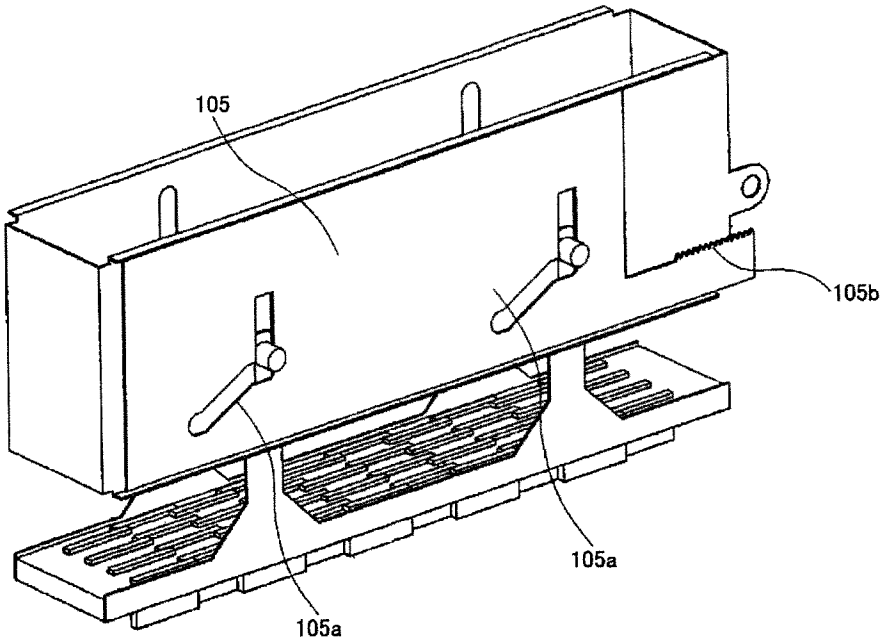
FIG. 32 is a perspective view of the first translation cam of the elevating mechanism according to modification 3, shown together with the frame, the head brackets, and the head part.

FIG. 32 is a perspective view of the first translation cam 105 of the elevating mechanism 1100, shown together with the frame 103, the head brackets 102, and the head part 40.

As shown in FIG. 32, the first rack gear 105*b* is provided at the bottom side of the right edge as viewed in FIG. 32 of the first translation cam 105.

Figure 33:
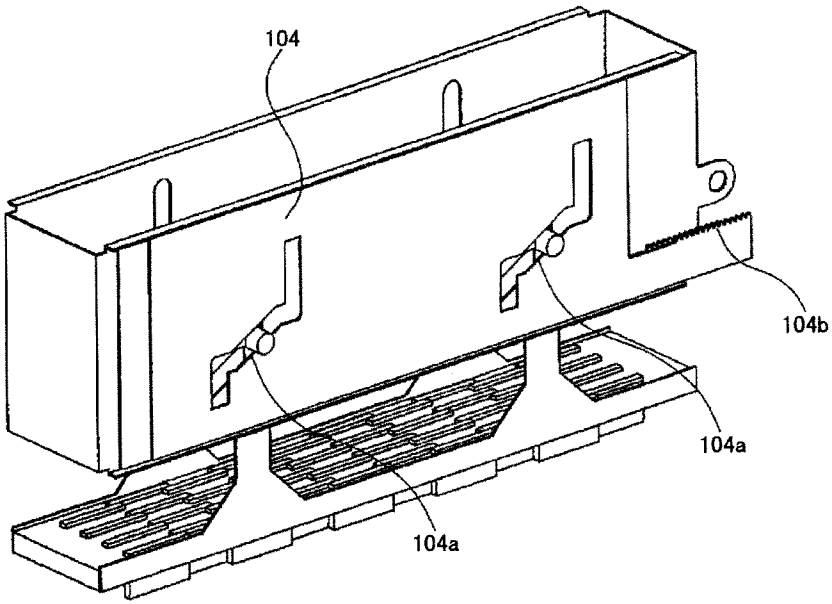
FIG. 33 is a perspective view of a configuration including the second translation cams added to the configuration of FIG. 32.

FIG. 33 is a perspective view of a configuration including the second translation cams 104 added to the configuration of FIG. 32.

As shown in FIG. 33, in the second translation cam 104 also, similar to the first translation cam 105, the second rack gear 104*b* is provided at the bottom side of the right edge as viewed in FIG. 33 of the second translation cam 104.

Figure 34:
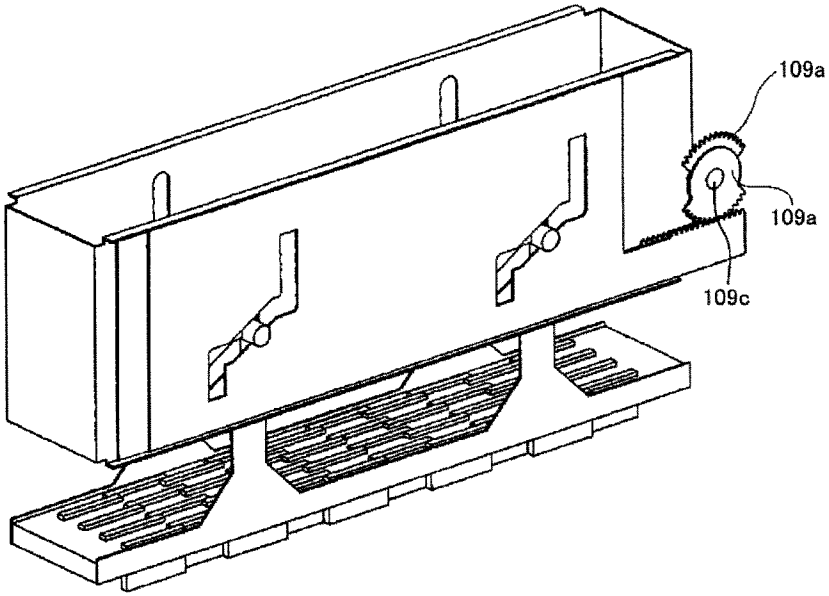
FIG. 34 is a perspective view of a configuration including a first intermittent gear and a second intermittent gear added to the configuration of FIG. 33.
Figure 35:
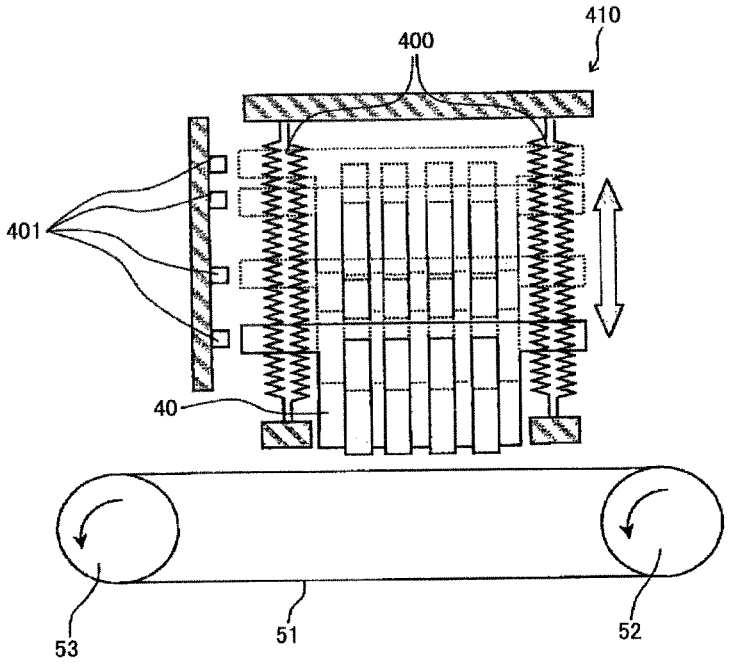
FIG. 35 illustrates a conventional elevating mechanism.

FIG. 34 is a perspective view of a configuration including the first intermittent gear 109*a* and the second intermittent gear 109*b* added to the configuration of FIG. 33.

As shown in FIG. 34, the first intermittent gear 109*a* and the second intermittent gear 109*b* are fixed to the same rotating shaft 109*c*. The first intermittent gear 109*a* is attached to a position to be in mesh-engagement with the first rack gear 105*b*, and the second intermittent gear 109*b* is attached to a position to be in mesh-engagement with the second rack gear 104*b*.

Furthermore, the gear part of the first intermittent gear 109*a* and the gear part of the second intermittent gear 109*b* are formed within a range of less than 180 degrees in the rotating direction. Furthermore, the first intermittent gear 109*a* and the second intermittent gear 109*b* are attached to the rotating shaft 509*c* in such a manner that the gear part of the second intermittent gear 109*b* is displaced by a phase of 180 degrees with respect to the gear part of the first intermittent gear 109*a*.

When the head part 40 is at a position for printing on plain paper, the first intermittent gear 109*a* is in mesh-engagement with the first rack gear 105*b*. When the rotating shaft 109*c* is rotated in the clockwise direction, the first translation cam 105 moves toward the right as viewed in FIG. 34, similar to the case indicated in FIG. 27B. When the move-use pin 102*a* is positioned at the position indicated in FIG. 27C, the mesh-engagement of the first intermittent gear 109*a* and the first rack gear 105*b* is released, and the first translation cam 105 stops moving.

From this state, when the rotating shaft 109*c* is further rotated in the clockwise direction, the second intermittent gear 109*b* and the second rack gear 104*b* come in mesh-engagement with each other, and the second translation cam 104 moves to the right side as viewed in FIG. 34, similar to the case indicated in FIG. 28A. Then, the move-use pin 102*a* reaches the position indicated in FIG. 28B, the mesh-engagement of the second intermittent gear 109*b* and the second rack gear 104*b* is released, and the second translation cam 104 stops moving.

By the configuration described above, a single motor can be used to alternately move the first translation cam 105 and the second translation cam 104. Accordingly, cost of the device can be reduced.

In modification 3, there are two translation cams. In a case where there are three translation cams, the phases of the gear parts of the intermittent gears are to be displaced by 120 degrees. Furthermore, in a case where there are four translation cams, the phases of the gear parts of the intermittent gears are to be displaced by 90 degrees.

The above descriptions are examples, and the following are the effects attained by the embodiments (1) through (6).

(1)

An image forming apparatus includes a liquid droplet jetting head such as the head part 40 configured to jet liquid droplets onto a sheet; and a movement mechanism such as the elevating mechanism 110 configured to move the liquid droplet jetting head in a direction orthogonal to a liquid droplet jet receiving surface of the recording medium, wherein the movement mechanism includes a plurality of translation cams 105, 104 provided in a manner as to be movable in a direction orthogonal to a movement direction of the liquid droplet jetting head, each of the plurality of translation cams including a cam gap into which a protruding part such as the move-use pin 102*a* provided on the liquid droplet jetting head is inserted, the cam gap 105*a*, 104*a* of each of the plurality of translation cams 105, 104 includes a parallel part such as a vertical gap extending in a parallel direction with respect to the movement direction of the liquid droplet jetting head and a slope part such as a slope gap that is sloped with respect to the movement direction of the liquid droplet jetting head, and the cap gaps of the plurality of translation cams 104, 105 are configured so as to constantly maintain a relationship in which when the protruding part is positioned in the slope part of the cap gap of any one of the plurality of translation cams among the plurality of translation cams 104, 105, the protruding part is positioned in the parallel part of the cap gap of a remaining one of the plurality of translation cams.

By the above configuration, as described in the embodiment, by moving the translation cam in which the protruding part is positioned in the slope part, the liquid droplet jetting head can be moved in a direction orthogonal to the liquid droplet jet receiving surface. Furthermore, when the protruding part moves in the slope part and reaches the vertical part, the protruding part stops moving. Therefore, even when there is a certain amount of delay in stopping the driving motor, or when the driving motor rotates by a certain amount due to inertia after the driving motor is stopped, the position where the liquid droplet jetting head stops is not displaced. Accordingly, without the need of controlling the driving motor to stop precisely, the liquid droplet jetting head can be precisely stopped at a predetermined position. Therefore, cost of the device can be reduced.

(2)

Furthermore, in the image forming apparatus according to (1), at least one of the plurality of translation cams includes the cap gap in which a plurality of the slope parts are formed.

By the above configuration, by a single translation cam, the liquid droplet jetting head can be moved between plural stages. Therefore, the number of translation cams can be reduced compared to a configuration in which each translation cam only includes a single slope part. Accordingly, the number of components can be reduced, and the cost of the device can be reduced.

(3)

Furthermore, in the image forming apparatus according to (2), the plurality of the slope parts are connected by the parallel part, and the plurality of the slope parts that are adjacent to each other across the parallel part have different slope directions from each other.

By the above configuration, the protruding part can be moved by moving the translation cam in a direction opposite to the previous movement direction. Consequently, the movement range of the translation cam can be made shorter compared to a configuration in which the slope parts are sloped in the same direction, and therefore the size of the device can be prevented from becoming large.

(4)

Furthermore, in the image forming apparatus according to (1) or (2), a rack gear is formed in each of the plurality of translation cams, a plurality of intermittent gears are provided corresponding to respective ones of the plurality of translation cams, the plurality of intermittent gears respectively include a gear part, and the plurality of intermittent gears are fixed to a same rotating shaft in a manner that the gear parts have different phases from each other.

By the above configuration, as described in modification 3, a single driving motor is used to move plural translation cams. Accordingly, the number of components can be reduced, and the cost of the device can be reduced.

(5)

Furthermore, in the image forming apparatus according to (3), each of the plurality of transition cams includes a front moving rack gear and a back moving rack gear facing each other and spaced apart from the front moving rack gear, a plurality of intermittent gears are provided corresponding to respective ones of the plurality of translation cams, the plurality of intermittent gears respectively include a gear part, and the plurality of intermittent gears are fixed to a same rotating shaft in a manner that the gear parts have different phases from each other.

By the above configuration, as described in modification 1, a single driving motor is used to sequentially move plural translation cams, and cause a reciprocating movement. Accordingly, the cost of the device can be reduced.

(6)

Furthermore, the image forming apparatus according to any one of (1) through (5) further includes a maintenance recovery device having a function for maintaining and recovering a performance of the liquid droplet jetting head, wherein the movement mechanism is configured such that the liquid droplet jetting head stops at least at a withdraw position at which the maintenance recovery device can withdraw to a position facing the liquid droplet jetting head, a maintenance recovery position at which the maintenance recovery device performs maintenance recovery, and a printing position at which the liquid droplets are jet onto the recording medium.

By the above configuration, as described in the embodiment, the liquid droplet jetting head can be precisely stopped at the respective positions, and therefore maintenance recovery and image formation on a recording media can be properly performed.

According to one embodiment of the present invention, an image forming apparatus is provided, by which the liquid droplet jetting head can be precisely stopped at a plurality of different predetermined positions in a direction orthogonal to a jet receiving surface without the need of precisely controlling a driving source, and casts of the device are prevented from increasing.

The image forming apparatus is not limited to the specific embodiments described herein, and variations and modifications may be made without departing from the scope of the present invention.

The present application is based on Japanese Priority Patent Application No. 2011-286413, filed on Dec. 27, 2011, the entire contents of which are hereby incorporated herein by reference.

What is claimed is:

1. An image forming apparatus comprising:

a liquid droplet jetting head configured to jet liquid droplets onto a recording medium; and a movement mechanism configured to move the liquid droplet jetting head in a direction orthogonal to a liquid droplet jet receiving surface of the recording medium, wherein the movement mechanism includes a plurality of translation cams provided in a manner to be movable in a direction orthogonal to a movement direction of the liquid droplet jetting head, each of the plurality of translation cams including a cam gap into which a protruding part provided on the liquid droplet jetting head is inserted, the plurality of translation cams includes a first translation cam and a second translation cam, the cam gap of each of the first and second translation cams includes a parallel part extending in a parallel direction with respect to the movement direction of the liquid droplet jetting head and a slope part that is sloped with respect to the movement direction of the liquid droplet jetting head, and the cam gaps of the first and second translation cams are configured so as to constantly maintain a relationship in which when the protruding part is positioned in the slope part of the cam gap of the first translation cam, the protruding part is positioned in the parallel part of the cam gap of the second translation cam, and when the protruding part is positioned in the parallel part of the cam gap of the first translation cam, the protruding part is positioned in the slope part of the cam gap of the second translation cam.

2. The image forming apparatus according to claim 1, wherein at least one of the plurality of translation cams includes the cam gap in which a plurality of the slope parts are formed.

3. The image forming apparatus according to claim 2, wherein the plurality of the slope parts are connected by the parallel part, and the plurality of the slope parts that are adjacent to each other across the parallel part have different slope directions from each other.

4. The image forming apparatus according to claim 1, wherein a rack gear is formed in each of the plurality of translation cams, a plurality of intermittent gears are provided corresponding to respective ones of the plurality of translation cams, the plurality of intermittent gears respectively include a gear part, and the plurality of intermittent gears are fixed to a same rotating shaft in a manner that the gear parts have different phases from each other.

5. The image forming apparatus according to claim 3, wherein each of the plurality of transition cams includes a front moving rack gear and a back moving rack gear facing each other and spaced apart from the front moving rack gear, a plurality of intermittent gears are provided corresponding to respective ones of the plurality of translation cams, the plurality of intermittent gears respectively include a gear part, and the plurality of intermittent gears are fixed to a same rotating shaft in a manner that the gear parts have different phases from each other.

6. The image forming apparatus according to claim 1, further comprising:

a maintenance recovery device having a function for maintaining and recovering a performance of the liquid droplet jetting head, wherein the movement mechanism is configured such that the liquid droplet jetting head stops at least at a withdraw position at which the maintenance recovery device can withdraw to a position facing the liquid droplet jetting head, a maintenance recovery position at which the maintenance recovery device performs maintenance recovery, and a printing position at which the liquid droplets are jet onto the recording medium.

* * * * *